US009063471B2

(12) United States Patent
Shiobara

(10) Patent No.: US 9,063,471 B2
(45) Date of Patent: Jun. 23, 2015

(54) ELECTROGRAPHIC IMAGE FORMING APPARATUS

(71) Applicant: Oki Data Corporation, Tokyo (JP)

(72) Inventor: Toshimasa Shiobara, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 13/947,524

(22) Filed: Jul. 22, 2013

(65) Prior Publication Data

US 2014/0029965 A1 Jan. 30, 2014

(30) Foreign Application Priority Data

Jul. 24, 2012 (JP) ..... 2012-163606

(51) Int. Cl.
*G03G 15/00* (2006.01)
*G03G 15/01* (2006.01)
*G03G 15/16* (2006.01)

(52) U.S. Cl.
CPC ..... *G03G 15/1605* (2013.01); *G03G 15/0189* (2013.01); *G03G 15/5058* (2013.01); *G03G 2215/0129* (2013.01); *G03G 2215/0158* (2013.01); *G03G 2215/0161* (2013.01)

(58) Field of Classification Search
USPC ..... 399/49, 301, 302, 388, 394
See application file for complete search history.

(56) References Cited

U.S. PATENT DOCUMENTS

| | | | | |
|---|---|---|---|---|
| 6,137,981 | A * | 10/2000 | Janssens et al. | 399/301 |
| 6,327,458 | B1 * | 12/2001 | Chapman | 399/394 |
| 6,990,300 | B2 * | 1/2006 | Saito et al. | 399/101 |
| 7,406,282 | B2 * | 7/2008 | Inui et al. | 399/299 |
| 7,885,586 | B2 * | 2/2011 | Yamamoto | 399/301 |
| 8,437,682 | B2 * | 5/2013 | Moriya | 399/395 |
| 2005/0254870 | A1 * | 11/2005 | Takahashi | 399/388 |
| 2007/0053727 | A1 * | 3/2007 | Goto | 399/301 |
| 2007/0242967 | A1 * | 10/2007 | Hano et al. | 399/49 |
| 2009/0214256 | A1 * | 8/2009 | Oshige | 399/119 |

FOREIGN PATENT DOCUMENTS

| | | | |
|---|---|---|---|
| JP | 2001-134041 | A | 5/2001 |
| JP | 2010-277038 | A | 12/2010 |

* cited by examiner

*Primary Examiner* — G. M. Hyder
(74) *Attorney, Agent, or Firm* — Muncy, Geissler, Olds & Lowe, P.C.

(57) ABSTRACT

An image forming apparatus includes a developer image forming part, an intermediate transfer body, a primary transfer part, a drive mechanism to drive the intermediate transfer body, a medium carrying mechanism, and a drive controller to control an operation of the medium carrying mechanism. The developer image forming part forms a mark developer image. The developer image detection part detects the mark developer image moving on a carrying path that is from a primary transfer position to a secondary transfer position, and the drive controller controls carrying of a medium based on a detection result of the mark developer image by the developer detection part.

20 Claims, 13 Drawing Sheets

ELECTROGRAPHIC IMAGE FORMING APPARATUS

CROSS REFERENCE TO RELATED APPLICATION

The present application is related to, claims priority from and incorporates by reference Japanese Patent Application No. 2012-163606, filed on Jul. 24, 2012.

TECHNICAL FIELD

The present invention relates to a technology for forming an image on a recording medium using an electrographic technique. In particular, the present invention relates to a technology for forming an image on a recording medium by transferring a developer image onto the recording medium via an intermediate transfer body using the electrographic technique.

BACKGROUND

An image forming process using the electrographic technique is widely adapted in image forming apparatus, such as photocopy machines, facsimile machines and printers. In the electrographic technique, a direct transfer technique and an intermediate transfer technique are known as methods to transfer a developer image onto a recording medium (hereinafter also referred to as "medium"), such as sheet and the like. The direct transfer technique is a technique to transfer the developer image formed directly on a photosensitive body onto a medium. In contrast, the intermediate transfer technique is a technique to transfer (secondary transfer) the a developer image from an intermediate transfer body onto a medium after once transferring (primary transfer) the developer image formed on a photosensitive body onto the intermediate transfer body. In the case of forming a color image in accordance with the intermediate transfer technique, a process is executed in which developer images of a plurality of colors (e.g., yellow, magenta, cyan and black) are transferred and superimposed on an intermediate transfer body and are subsequently transferred onto a medium.

JP Laid-Open Patent Application No. 2010-277038 and JP Laid-Open Patent Application No. 2001-134041 are examples of prior art documents related to the intermediate transfer technique.

For the intermediate transfer technique, accurate positioning of the developer image on the intermediate transfer body and the medium being carried is required. However, a change in the size of the intermediate transfer body or the occurrence of displacement of the intermediate transfer body inside the image forming apparatus during the operation of the image forming apparatus, for example, often causes the accuracy in positioning the developer image on the intermediate transfer body and the medium to decrease.

In view of the above-described problems, an object of the present invention is to provide an image forming apparatus that improves the accuracy in positioning the developer image on the intermediate transfer body and the medium.

SUMMARY

An image forming apparatus according to one embodiment of the invention includes a developer image forming part that is configured to form a developer image, an intermediate transfer body that is configured to hold and carry the developer image that is transferred from the developer image forming part to a transferred surface thereof, a primary transfer part that is configured to transfer the developer image from the developer image forming part to the transferred surface at a primary transfer position, a drive mechanism that is configured to drive the intermediate transfer body to carry the developer image on the transferred surface on a carrying path that is defined from the primary transfer position to a secondary transfer position located on a downstream side of the primary transfer position, a medium carrying mechanism that is configured to carry a medium to the secondary transfer position, a secondary transfer part that is configured to transfer the developer image from the intermediate transfer body to the medium at the secondary transfer position, a developer image detection part that is configured to detect the developer image on the intermediate transfer body, and a drive controller that is configured to control an operation of the medium carrying mechanism. Wherein, the developer image forming part forms a mark developer image, the primary transfer part transfers the mark developer image from the developer image forming part to the transferred surface of the intermediate transfer body, the drive mechanism drives the intermediate transfer body to carry the mark developer image on the transferred surface along the carrying path, the developer image detection part detects the mark developer image moving on the carrying path, and the drive controller controls carrying of the medium based on a detection result of the mark developer image by the developer detection part.

The image forming apparatus according to the present invention detects a marking developer image that moves on the carrying path between the primary transfer position to the secondary transfer position and controls the carrying of the medium based on a detection result. Therefore, the accuracy in positioning between the developer image and the medium at the secondary transfer position is improved.

DETAILED DESCRIPTION OF EMBODIMENTS

Various embodiments according to the present invention are explained below with reference to the drawings.

First Embodiment

Figure 1:
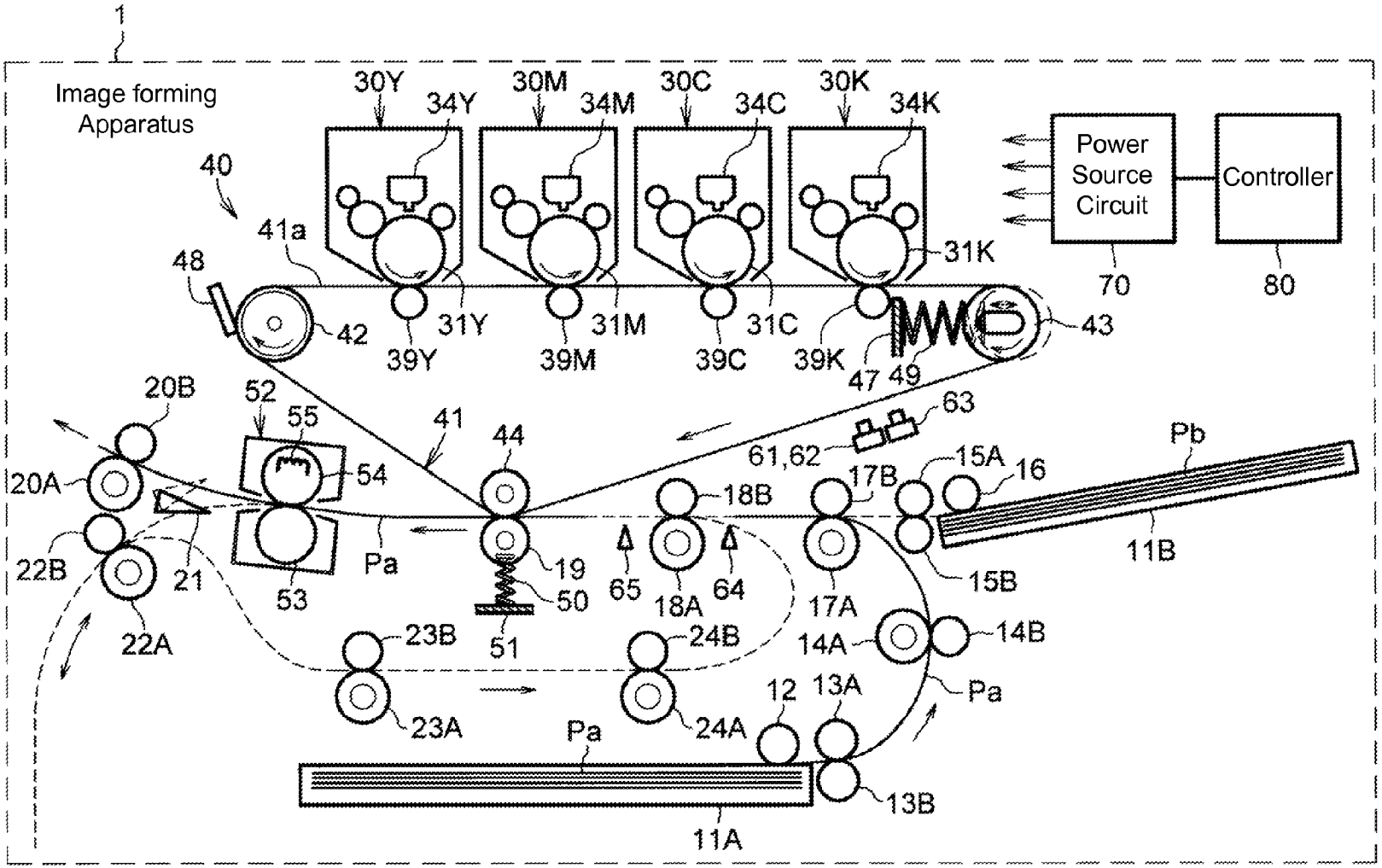
FIG. 1 is a diagram schematically illustrating a main component of an image forming apparatus of a first embodiment that operates using the electrographic technique.
Figure 2:
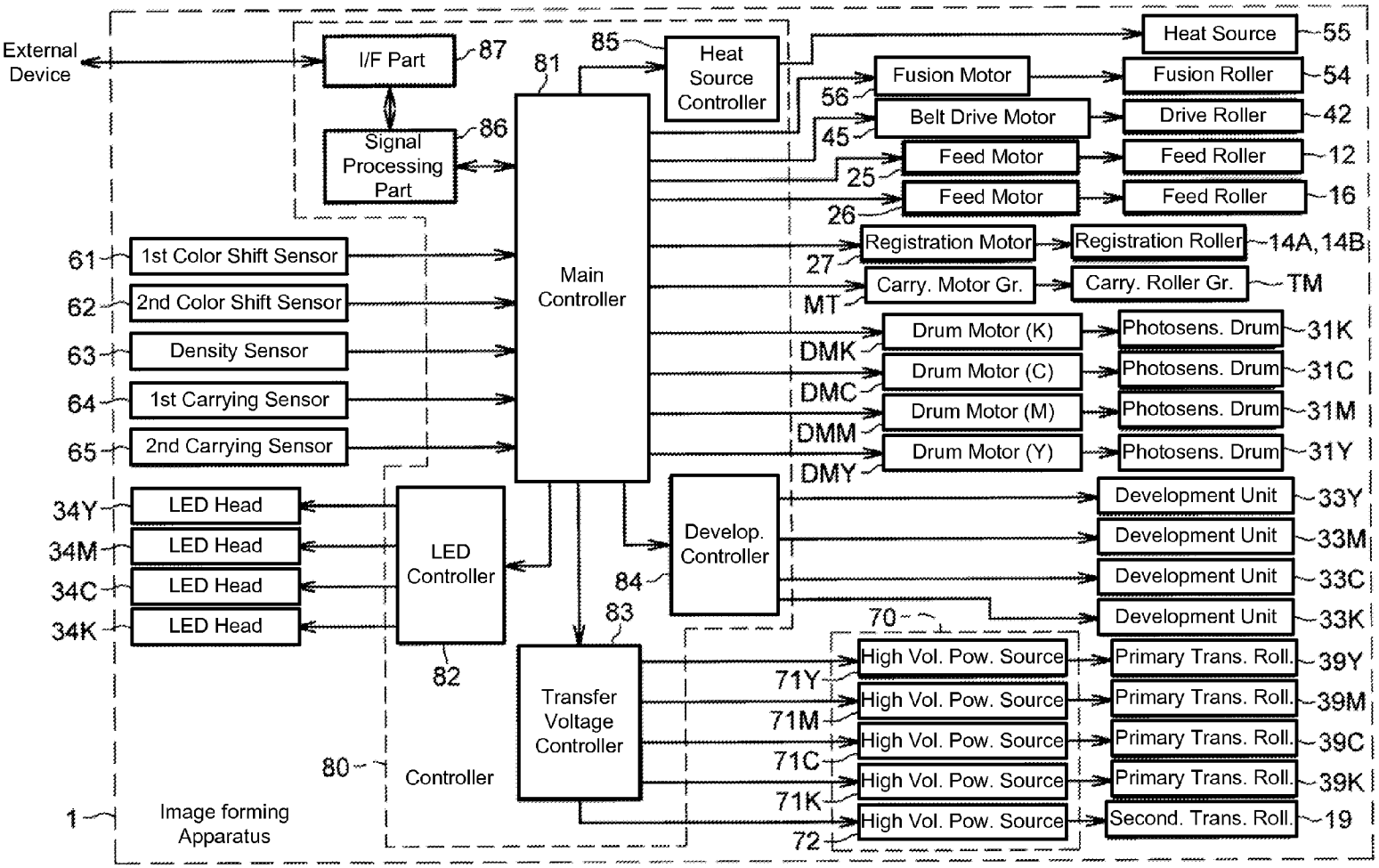
FIG. 2 is a functional block diagram schematically illustrating the image forming apparatus in FIG. 1.

FIG. 1 is a diagram schematically illustrating a main component of an image forming apparatus 1 of a first embodiment that operates using the electrographic technique. FIG. 2 is a functional block diagram schematically illustrating the image forming apparatus 1 in FIG. 1.

The image forming apparatus 1 includes a controller 80 that controls entire operation of the image forming apparatus 1 and a power source circuit 70. As shown in FIG. 2, the controller 80 includes a main controller (drive controller) 81, a light emitting diode (LED) controller 82, a transfer voltage controller 83, a development controller 84, a heat source controller 85, a signal processing part 86 and an interface part (I/F part) 87. The I/F part 87 includes a function for communication interface between an external device, such as an electronic device, and the signal processing part 86. The signal processing part 86 receives print data and control signals from the external device via the I/F part 87. An image formation controller is configured from the LED controller 82, the transfer voltage controller 83 and the development controller 84.

As shown in FIG. 1, the image forming apparatus 1 includes a cassette 11A that accommodates a recording medium Pa, a tray 11B that accommodates a recording medium Pb, an intermediate transfer belt unit 40, four image forming units (development units) 30Y, 30M, 30C and 30K that configure a developer image forming part, primary transfer rollers (primary transfer members) 39Y, 39M, 39C and 39K that form a primary transfer part, a secondary transfer roller 19, and a cleaning member 48 that collects developer remaining on the intermediate transfer belt 41 after secondary transfer.

The intermediate transfer belt unit 40 is configured by including an intermediate transfer belt 41 that forms an intermediate transfer body, a drive roller 42 that drives the intermediate transfer belt 41, an idle roller 43 as a driven roller, a backup roller 44, an elastic biasing member 49 that biases the idle roller 43 in a predetermined direction. Each of the drive roller 42, the idle roller 43 and the backup roller 44 is held freely rotatably about the respective rotational axes that is perpendicular to the drawing.

The intermediate transfer belt 41 is an endless elastic belt made of a resin material, such as polyimide resin and the like. The intermediate transfer belt 41 is tensioned (bridged) on the drive roller 42, the idle roller 43 and the backup roller 44. The drive roller 42 circulates and rotates the intermediate transfer belt 41 by receiving motive force transmitted from a belt drive motor 45 in FIG. 2 via a belt frame (not shown) and by being rotated in the clockwise direction. Here, operation of the belt drive motor 45 is controlled by the main controller 81 in FIG. 2. The drive roller 42 is positioned on the upstream side of the image forming units 30Y, 30M, 30C and 30K in the feeding direction of the intermediate transfer belt 41. The idle roller 43 is positioned on the downstream side of the image forming units 30Y, 30M, 30C and 30K in the feeding direction thereof. The drive roller 42, the idle roller 43 and the elastic biasing member 49 configure a drive mechanism that drives the intermediate transfer belt 41. In addition, the drive roller 42, the idle roller 43 and the backup roller 44 configure a tension member that allows the intermediate transfer belt 41 to be tensioned (bridged) thereon.

A base end of the elastic biasing member 49 is fixed on a frame 47 of the image forming apparatus 1. A front end of the elastic biasing member 49 provides appropriate tension to the entire intermediate transfer belt 41 by pressing and biasing the idle roller 43 in a direction to apply tension on the intermediate transfer belt 41. When the intermediate transfer belt 41 passes through a nip part between the image forming units 30Y, 30M, 30C and 30K and the primary transfer rollers 39Y, 39M, 39C and 39K and when the intermediate transfer belt 41 contacts and separates from the drive roller 42 and the backup roller 44, the tension of the impacted intermediate belt 41 fluctuates. The elastic biasing member 49 reduces the fluctuation of the tension of the intermediate transfer belt 41 caused by such impacts.

The backup roller 44 and the secondary transfer roller 19 configure a secondary transfer part that transfers the developer image on a transferred surface 41*a* of the intermediate transfer belt 41 onto the recording media Pa and Pb. The backup roller 44 and the secondary transfer roller 19 are positioned so as to face each other and to sandwich the intermediate transfer belt 41 therebetween. The secondary transfer roller 19 is configured from a metal core and an elastic layer (e.g. foamed rubber layer) formed to coat an outer circumferential surface of the core. The secondary transfer roller 19 is biased in the direction of the backup roller 44 by a spring shaped elastic biasing member 50. A base end of the elastic biasing member 50 is fixed on a frame 51 of the image forming apparatus 1. A front end of the elastic biasing member 50 presses the secondary transfer roller 19. Use of this elastic biasing member 50 reduces vibration of the secondary transfer roller 19 generated when the recording media Pa and Pb pass through a nip part between the backup roller 44 and the secondary roller 19.

Figure 3:
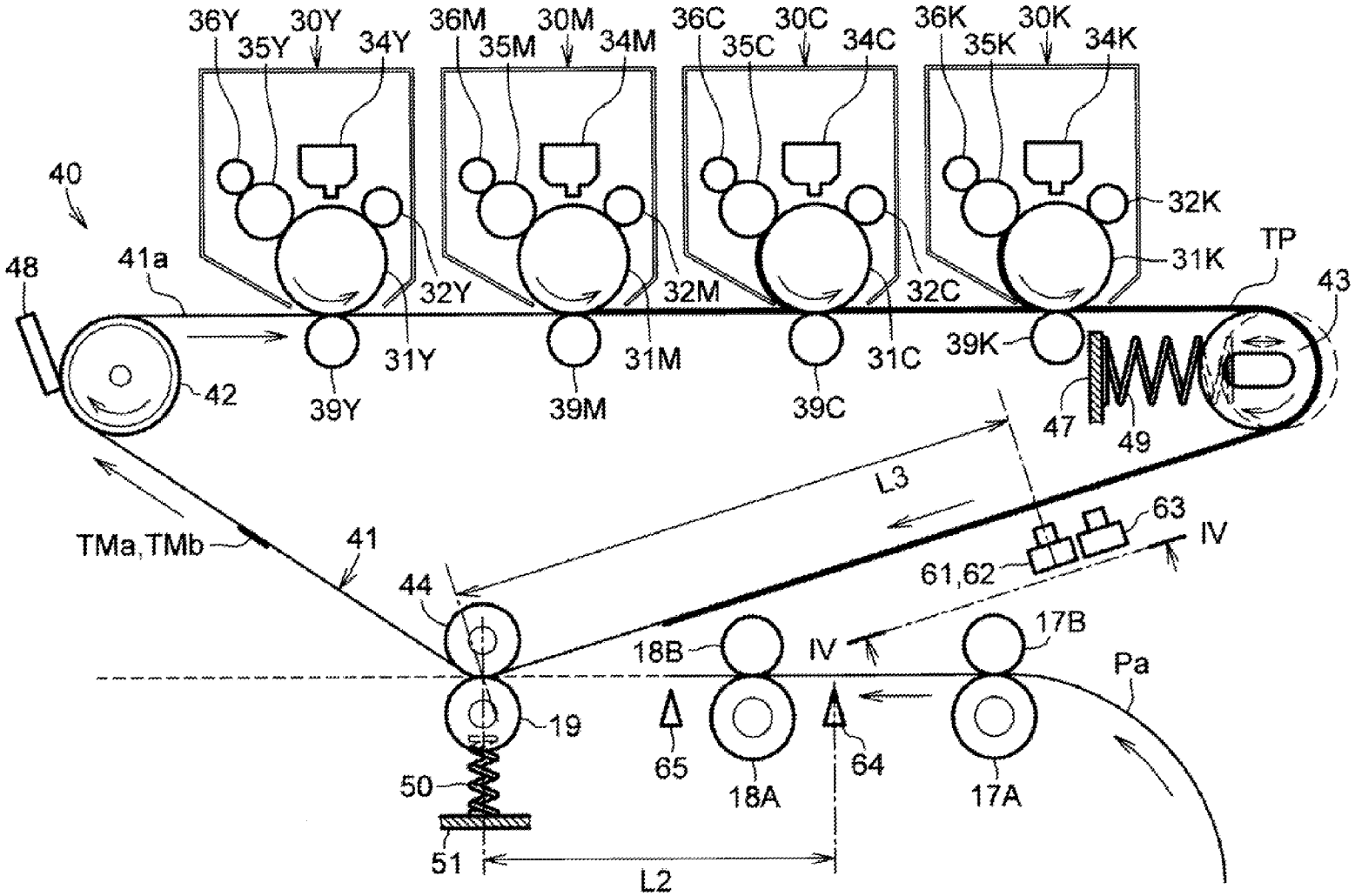
FIG. 3 is a schematic diagram illustrating an enlargement of a main part of the image forming apparatus in FIG. 1.

The image forming units 30Y, 30M, 30C and 30K have respectively contain yellow, magenta, cyan and black developers (including powder toner) and have a function to form an image formed with the yellow (Y), magenta (M), cyan (C) and black (K) developers, respectively. FIG. 3 is a schematic diagram illustrating an enlargement of a main part of the image forming apparatus 1 in FIG. 1. As shown in FIG. 3, the image forming units 30Y, 30M, 30C and 30K are arranged at positions to face the primary transfer rollers 39Y, 39M, 39C and 39K, respectively, over the intermediate transfer belt 41. The primary transfer rollers 39Y, 39M, 39C and 39K are biased in a direction of the image forming units 30Y, 30M, 30C and 30K by biasing members (not shown). As a result, the image forming units 30Y, 30M, 30C and 30K and the primary transfer rollers 39Y, 39M, 39C and 39K are arranged to sandwich the intermediate transfer belt 41 therebetween.

The image forming unit 30Y that forms a yellow developer image is arranged at the most upstream position in the feeding direction of the intermediate transfer belt 41 among the image forming units 30Y, 30M, 30C and 30K. This image forming unit 30Y includes a photosensitive body (e.g., photosensitive drum) 31Y, a charging roller 32Y that uniformly changes a surface of the photosensitive drum 31Y, an LED head (exposure part) 34Y for exposing the surface of the rotating photosensitive drum 31Y to form an electrostatic latent image that corresponds to a print image thereon, a development roller 35Y that is a developer carrier, and a supply roller 36Y that supplies yellow developer onto the development roller 35Y. A drum motor DMY shown in FIG. 2 causes the photosensitive drum 31Y to be rotated, by receiving a control by the main controller 81. The charging roller 32Y, the development roller 35Y and the supply roller 36Y configure a development unit 33Y that operates by receiving a control by the development roller 84 shown in FIG. 2. When a part of the surface of the photosensitive drum 31Y, on which the electrostatic latent image has been formed, reaches the developer roller 35, the yellow developer moves onto the photosensitive drum 31Y due to a potential difference between the electrostatic latent image on the photosensitive drum 31Y and the development roller 35Y to form a developer image (toner image) on the photosensitive drum 31Y. Thereafter, the developer image on the photosensitive drum 31Y is carried to a primary transfer position and is transferred to the transferred surface 41*a* on the intermediate transfer belt 41 by the primary transfer roller 39Y. At this time, because a transfer bias is applied to the primary transfer roller 39A, the developer image is transferred onto the intermediate transfer belt 41 that is nipped (pinched) between the primary transfer roller 39Y and the photosensitive drum 31Y. The image forming unit 30Y also includes a development blade that reduces a thickness of a developer layer (toner layer) on the surface of the development roller 35Y and a cleaning member that scrapes off the remaining developer on the surface of the photosensitive drum 31Y after the primary transfer. However, these development blade and cleaning member are not illustrated.

Other image forming units 30M, 30C and 30K have the same configuration as the image forming unit 30Y. That is, the image forming unit 30M that forms a magenta developer image includes a photosensitive body (e.g., photosensitive drum) 31M, a charging roller 32M that uniformly changes a surface of the photosensitive drum 31M, an LED head (exposure part) 34M for exposing the surface of the rotating photosensitive drum 31M to form an electrostatic latent image that corresponds to a print image thereon, a development roller 35M that is a developer carrier, and a supply roller 36M that supplies magenta developer onto the development roller 35M. A drum motor DMM shown in FIG. 2 causes the photosensitive drum 31M to be rotated, by receiving a control by the main controller 81. The charging roller 32M, the development roller 35M and the supply roller 36M configure a development unit 33M that operates by receiving a control by the development roller 84 shown in FIG. 2.

In addition, the image forming unit 30C that forms a cyan developer image includes a photosensitive body (e.g., photosensitive drum) 31C, a charging roller 32C that uniformly changes a surface of the photosensitive drum 31C, an LED head (exposure part) 34C for exposing the surface of the rotating photosensitive drum 31C to form an electrostatic latent image that corresponds to a print image thereon, a development roller 35C that is a developer carrier, and a supply roller 36C that supplies cyan developer onto the development roller 35C. A drum motor DMC shown in FIG. 2 causes the photosensitive drum 31C to be rotated, by receiving a control by the main controller 81. The charging roller 32C, the development roller 35C and the supply roller 36C configure a development unit 33C that operates by receiving a control by the development roller 84 shown in FIG. 2.

The image forming unit 30K that forms black developer image is arranged at the most downstream side position in the feeding direction of the intermediate transfer belt 41 among the image forming units 30Y, 30M, 30C and 30K. The image forming unit 30K includes a photosensitive body (e.g., photosensitive drum) 31K, a charging roller 32K that uniformly changes a surface of the photosensitive drum 31K, an LED head (exposure part) 34K for exposing the surface of the rotating photosensitive drum 31K to form an electrostatic latent image that corresponds to a print image thereon, a development roller 35K that is a developer carrier, and a supply roller 36K that supplies black developer onto the development roller 35K. A drum motor DMK shown in FIG. 2 causes the photosensitive drum 31K to be rotated, by receiving a control by the main controller 81. The charging roller 32K, the development roller 35K and the supply roller 36K configure a development unit 33K that operates by receiving a control by the development roller 84 shown in FIG. 2. As discussed later, the image forming unit 30K forms mark images (marking developer images) TMa and TMb that do not correspond to the print image and transfer these mark images TMa and TMb onto the intermediate transfer belt 41 prior to the developer image that corresponds to the print image.

The above-described photosensitive drums 31Y, 31M, 31C and 31K are each configured from a metal pipe (conductive base material), such as aluminum, and a photoconductive layer, such as an organic photoconductor (OPC) formed around the metal pipe. The LED heads 34Y, 34M, 34C and 34K operate by receiving a control by the LED controller 82. Although illustration is omitted, the LED head 34Y includes a plurality of LED elements (light emitting diode elements) arrayed along a longitudinal direction (axial direction) of the photosensitive rum 31Y, an LED driving part that drives the LED elements and a lens array that directs light emission from the LED elements onto the surface of the photosensitive drum 31Y. The other LED heads 34M, 34C and 34M have the same configuration as the LED head 34Y.

As shown in FIG. 2, the power source circuit 70 includes high voltage power sources 71Y, 71M, 71C and 71K that operate by receiving a control by the transfer voltage controller 83. These high voltage power sources 71Y, 71M, 71C and 71K supply a transfer bias for the primary transfer to the primary transfer rollers 39Y, 39M, 39C and 39K, respectively. By the transfer bias, the yellow, magenta, cyan and black developer images are sequentially transferred from the photosensitive drums 31Y, 31M, 31C and 31K onto the transferred surface 41*a* of the intermediate transfer belt 41, at the nip part at the primary transfer position between the photosensitive drums 31Y, 31M, 31C and 31K and the primary transfer rollers 39Y, 39M, 39C and 39K, respectively. At the nip part between the most downstream side photosensitive drum 31K and the primary transfer roller 39K, the yellow, magenta, cyan and black developer images are superimposed. As a result, a color developer image TP is formed on the intermediate transfer belt 41. The intermediate transfer belt 41 carries the color developer image TP toward the secondary transfer position between the backup roller 44 and the secondary transfer roller 19 while holding the color developer image TP on the transferred surface 41*a*.

Now, as shown in FIG. 1, the image forming apparatus 1 includes a cassette 11A that accommodates a plurality of recording media Pa in a stacked state, a feed roller 12 that takes up and feeds the recording media Pa from the cassette 11A, separation means (roller members) 13A and 13B that separate the recording media Pa fed from the cassette 11A by pinching each sheet, a pair of registration rollers 14A and 14B that pinch and guide the recording medium Pa supplied from the separation means 13A and 13B, a pair of carrying rollers 17A and 17B and a pair of carrying rollers 18A and 18B. The feed roller 12 receives motive force transmitted from the feed motor 25 in FIG. 2 and rotates to remove the recording media Pa from the cassette 11A and feeds them to the separation means 13A and 13B. In addition, the registration rollers 14A and 14B carry each recording medium Pa while correcting skew (state of the recording medium Pa diagonally traveling with respect to the carrying direction) by rotating as the registration rollers 14A and 14B receive a motive force transmitted from a registration motor (stepping motor) shown in FIG. 2. The main controller 81 is capable of individually controlling operation of the feed motor 25 and the registration motor 27.

The carrying rollers 17A and 17B pinch the recording medium Pa supplied from the registration rollers 14A and 14B and feed the recording medium Pa to a region between the carrying rollers 18A and 18B. The carrying rollers 18A and 18B feed the recording medium Pa to a nip part at the secondary transfer position between the secondary transfer roller 19 and the backup roller 44 while correcting the skew on the recording medium Pa supplied from the carrying rollers 17A and 17B. The carrying rollers 17A, 17B, 18A and 18B configure a carrying roller group TM in FIG. 2. The carrying rollers 17A, 17B, 18A and 18B receive a motive force transmitted from a carrying motor group MT in FIG. 2 and rotate to carry the recording medium Pa. The main controller 81 is capable of controlling operation of the carrying motor group MT.

Moreover, the image forming apparatus 1 includes a tray 11B that accommodates a plurality of recording media Pb that are different from the recording media Pa, a feed roller 16 that takes up and feeds the recording media Pb from the tray 11B, separation means (roller members) 15A and 15B that separate the recording media Pb fed from the tray 11B by pinching each sheet. The feed roller 16 receives motive force transmitted from the feed motor 26 in FIG. 2 and rotates to remove the recording media Pb from the cassette 11B and feeds them to the separation means 15A and 15B. The main controller 81 controls the operation of the feed roller 16. The carrying rollers 17A, 17B, 18A and 18B also feed the recording medium Pb to the secondary transfer position when the recording medium Pb is supplied from the tray 11B. The above-described separation means 13A, 13B, 15A and 15B, the registration rollers 14A and 14B, and the carrying rollers 17A, 17B, 18A and 18B form a medium carrying mechanism.

Sheet-shaped materials, such as paper, synthetic paper, thick paper, special paper, plastic film and cloth, are examples of the recording media Pb and Pa. In the present embodiment, the recording media Pb and Pa have different materials and thicknesses. However, the present embodiment is not limited to this condition.

The backup roller 44 and the secondary transfer roller 19 transfer (secondarily transfer) the color developer image TP on the transferred surface 41*a* onto the recording medium Pa (or Pb) that has been supplied from the carrying rollers 18A and 18B. At that time, because a potential difference is generated between the secondary transfer roller 19 and the backup roller 44 as a transfer bias (direct current voltage) is applied to the secondary transfer roller 19, the color developer image TP is transferred to the recording medium Pa (or Pb) due to the potential difference. The high voltage power source 72 in FIG. 2 operates by receiving a control by the transfer voltage controller 83 and supplies the transfer bias to the secondary transfer roller 19.

The cleaning member 48 removes the remaining developer on the intermediate transfer belt 41 after the secondary transfer. An edge part of the cleaning member 48 is positioned to contact the transferred surface 41*a* of the intermediate transfer belt 41 at a constant pressure. Therefore, the remaining developer carried from the secondary transfer part is scraped off from the intermediate transfer belt 41.

The backup roller 44 and the secondary transfer roller 19 feed the recording medium Pa (or Pb), on which the color developer image TP has been secondarily transferred, to a fusion unit 52. The fusion unit 52 includes a function to fix the developer image transferred onto the recording medium Pa to the recording medium Pa. The fusion unit as shown in FIG. 1 includes a freely rotatable cylindrical fusion roller 54 and a freely rotatable backup roller (pressure application roller) 53 that has a surface layer made of an elastic material. By applying pressure and heat to the recording medium Pa nipped (pinched) between the fusion roller 54 and the backup roller 53, the fusion unit 52 melts and fixes the developer image on the recording medium Pa. The fusion motor 56 in FIG. 2 operates by receiving a control by the main controller 81 and rotates the fusion roller 54. A heat source 55, such as a halogen lamp or the like, is arranged inside the fusion roller 54. The heat source controller 85 in FIG. 2 controls a surface temperature of the fusion roller 54 by controlling a bias voltage to be supplied to the heat source 55.

The recording medium Pa (or Pb) fed from the fusion unit 52 is supplied to either one of a pair of carrying rollers 20A and 20B and a pair of switchback rollers 22A and 22B in accordance with orientation of a separator 21. As shown in FIG. 1, when the separator 21 is at a normal orientation, the carrying rollers 20A and 20B eject the recording medium Pa supplied from the fusion unit 52 outside the image forming apparatus 1 while pinching the recording medium Pa.

On the other hand, when the orientation of the separator 21 is switched to a switchback orientation as indicated by broken lines, a travelling direction of the recording medium Pa fed from the fusion unit 52 is changed to a direction of a switchback carrying mechanism. The switchback carrying mechanism forms a part of the medium carrying mechanism and is a configuration for directing the supplied recording medium Pa to the secondary transfer position again to print both sides of the recording medium Pa. That is, the switchback carrying mechanism includes the pair of switchback rollers 22A and 22B, a pair of carrying rollers 23A and 23B and a pair of carrying rollers 24A and 24B. The switchback rollers 22A and 22B carry a front end of the supplied recording medium Pa towards a bottom part of the image forming apparatus 1 while pinching the recording medium Pa, reverse the carrying direction of the recording medium Pa to an opposite direction thereafter, and feed a rear end of the recording medium Pa to the pair of carrying rollers 23A and 23B. The carrying rollers 23A, 23B, 24A and 24B guide the supplied recording medium Pa to the carrying rollers 18A and 18B while pinching the recording medium Pa. The carrying rollers 18A and 18B feed the recording medium Pa supplied from the carrying rollers 24A and 24B to the secondary transfer position again.

The image forming apparatus 1 includes a drive part group (not shown), such as stepping motor that rotates the carrying rollers 20A, 20B, 22A, 22B, 23A, 23B, 24A and 24B, and the like. The main controller 81 controls operation of the drive part group.

As shown in FIG. 3, the image forming apparatus 1 includes a first color shift sensor 61, a second color shift sensor 62 and a density sensor 63. These first color shift sensor 61, second color shift sensor 62 and density sensor 63 are arranged at positions to face the transferred surface 41*a* of the intermediate transfer belt 41 in the vicinity of the carrying path of the developer image between the idle roller 43 and the backup roller 44, that is, in the vicinity of the carrying path of the developer image between the primary transfer position and the secondary transfer position. In addition, the first color shift sensor 61, the second color shift sensor 62 and the density sensor 63 are arranged in the vicinity of the backup roller 44. Here, the vicinity of the backup roller 44 means that the distance of the first color shift sensor 61, the second color shift sensor 62 and the density sensor 63 from the backup roller 44 is within 35% of a length of a tangent line connecting the idle roller 43 and the backup roller 44.

Figure 4:
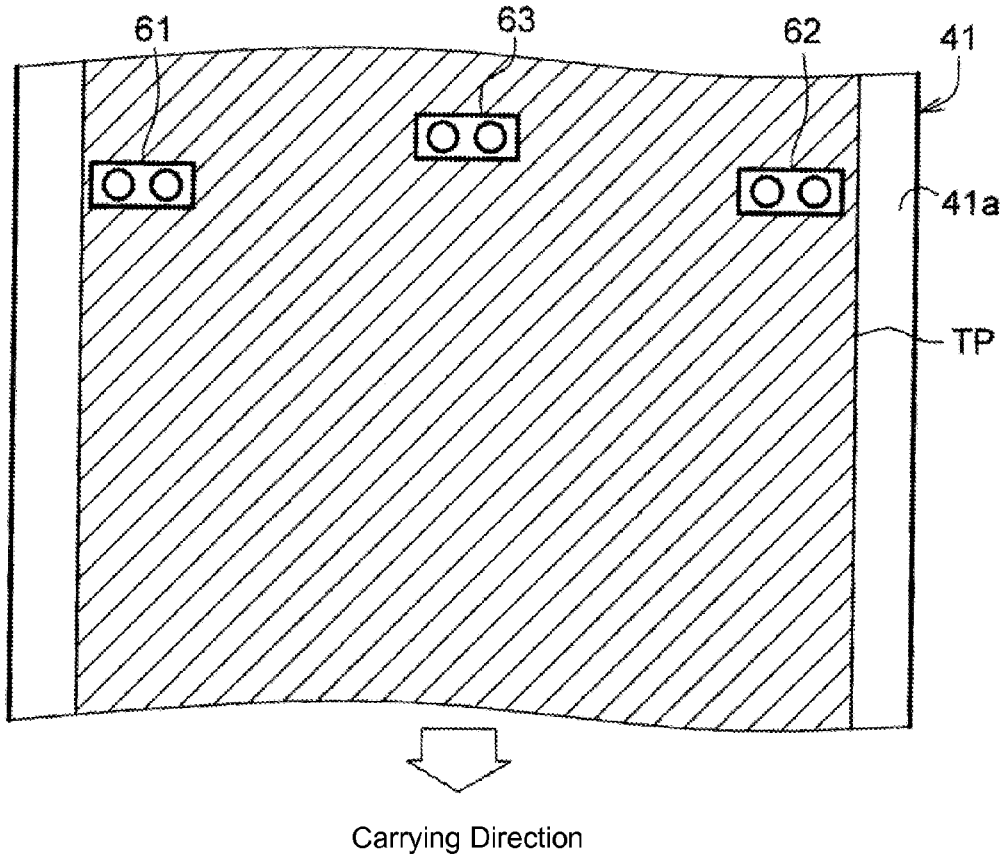
FIG. 4 is a view seen in an arrow direction along the IV-IV line in FIG. 3.

FIG. 4 is a view seen in an arrow direction along the IV-IV line in FIG. 3. As shown in FIG. 4, the first color shift sensor 61 and the second color shift sensor 62 are arranged at positions facing near both edges of the formation region of the color developer image TP on the transferred surface 41*a* in the width direction (direction perpendicular to the carrying direction of the color developer image TP). The density sensor 63 is arranged at a position facing an approximately center position of the transferred surface 41*a* in the width direction.

The first color shift sensor 61 and the second color shift sensor 62 are optical sensors that are used for the purpose of correcting a shift (color shift) of the transfer position of the developer images between yellow (Y), magenta (M), cyan (C) and black (K). In the present embodiment, the first color shift sensor 61 and the second color shift sensor 62 configure developer detection parts that detect predetermined pattern images (color developer images) that are formed for correcting the color shift. Each of the first color sensor 61 and the second color sensor 62 is configured from a light emitting diode that emits light towards the transferred surface 41*a* and a light receiving element, such as a phototransistor and a photodiode, that receives reflection light thereof, for example. The light receiving element supplies electric signals that correspond to the amount of light received to the main controller 81 in FIG. 2. The main controller 81 includes a function to generate a color shift sensor signal CE1 by binarizing the electric signals outputted from the first color shift sensor 61 and to generate a color shift sensor signal CE2 by binarizing the electric signals outputted from the second color shift sensor 62. The main controller 81 measures color shift between yellow, magenta, cyan and black based on the color shift sensor signals CE1 and CE2 obtained in correspondence with the pattern images for color shift correction. The LED controller 82 automatically corrects the color shift by individually controlling exposure operation of the LED heads 34Y, 34M, 34C and 34K based on a measurement result of the color shift. A method for correcting the color shift is disclosed in JP Laid-Open Patent Application No. 2001-134041, for example. The color correction may be executed by using this method. JP Laid-Open Patent Application No. 2001-134041 is incorporated herein by reference.

The density sensor 63 is an optical sensor used for detecting and correcting density of the developer images in each color of yellow (Y), magenta (M), cyan (C) and black (K). In response to aging of the characteristics of each of the image forming units 30Y, 30M, 30C and 30K (e.g., aging of sensitivity characteristics of the photosensitive drums 31Y, 31M, 31C and 31K and charging characteristics of the developer images) or changes in usage environment, fluctuations in density between the developer images in yellow (Y), magenta (M), cyan (C) and black (K) or shift from an optimum value of the density occurs. Therefore, the main controller 81, the LED controller 82, the transfer voltage controller 83 and the development controller 84 include a function to correct the density of the developer image by individually changing control conditions for the image forming units 30Y, 30M, 30C and 30K and the primary transfer rollers 39Y, 39M, 39C and 39K based on the result in detecting the density of each color by the density sensor 63. The density sensor 63 is configured from a light emitting diode that irradiates light towards the transferred surface 41*a*, and a light receiving element, such as a phototransistor, a photodiode and the like, that receives the reflection light, for example. The light receiving element supplies electric signals corresponding to the amount of light received, to the main controller 81 in FIG. 2. The controller 81 generates a density sensor signal PD by binarizing the electric signals outputted from the density sensor 63. In the present embodiment, the density sensor signal PD is used for correcting the density with the density of the black (K) developer image as reference.

As shown in FIG. 3, a developer image carrying distance L3 from a facing position on the transferred surface 41*a* that faces the centers of the first color shift sensor 61 and the second color shift sensor 62 to the secondary transfer position is longer than the carrying distance from the idle roller 43 to the facing position. The carrying distance L3 does not substantially change during the print operation of the image forming apparatus 1.

In addition, as shown in FIG. 3, the image forming apparatus 1 includes a first carrying sensor 64 and a second carrying sensor 65 as medium detection sensors that detect the recording medium Pa (or Pb) moving on the carrying path toward the secondary transfer position. These first carrying sensor 64 and second carrying sensor 65 are arranged at downstream side positions. The second carrying sensor 65 is arranged at a further downstream side position (position closer to the secondary transfer position) than the first carrying sensor 64. The first carrying sensor 64 and the second carrying sensor 65 may be a contact sensor that detects the passing recording medium Pa (or Pb) by contacting the recording medium Pa (or Pb) moving on the carrying path, or a non-contact sensor that optically detects the passing recording medium Pa (or Pb). The main controller 81 generates carrying sensor signals FD1 and FD2 by binarizing electric signals respectively outputted from the first carrying sensor 64 and the second carrying sensor 65. The main controller 81 timely adjusts timing at which the recording medium Pa (or Pb) reaches the secondary transfer position by controlling operation of the feeding motors 25 and 26 and the carrying motor group MT based on these carrying sensor signals FD1 and FD2. A carrying distance L2 of the recording medium Pa from the position that corresponds to the center of the first carrying sensor 64 to the secondary transfer position does not substantially change even during the print operation of the image forming apparatus 1.

Next, the operation of the image forming apparatus 1 is explained.

When print image data is inputted from an external device to the image forming apparatus I in an active state through the I/F part 87, the signal processing part 86 sends a print command to the main controller 81, generates bitmap data for Y components, M components, C components and K components based on the inputted print image data, and outputs the bitmap data to the main controller 81. In response to the print command from the signal processing part 86, the main controller 81 starts print operation for the bit map data by cooperating with the LED controller 82, the transfer voltage controller 83, the development controller 84 and the heat source controller 85.

FIGS. 5A to 5D are timing charts for explaining the print operation of the image forming apparatus 1. When the print operation starts, the main controller 81 starts rotating the belt drive motor 45 and the drum motors DMY, DMC, DMM and DMK. As a result, the intermediate transfer belt 41 and the photosensitive drums 31Y, 31M, 31C and 31K are driven. In addition, the developer controller 84 starts charging operation for the charging rollers 32Y, 32M, 32C and 32K.

Figure 5:
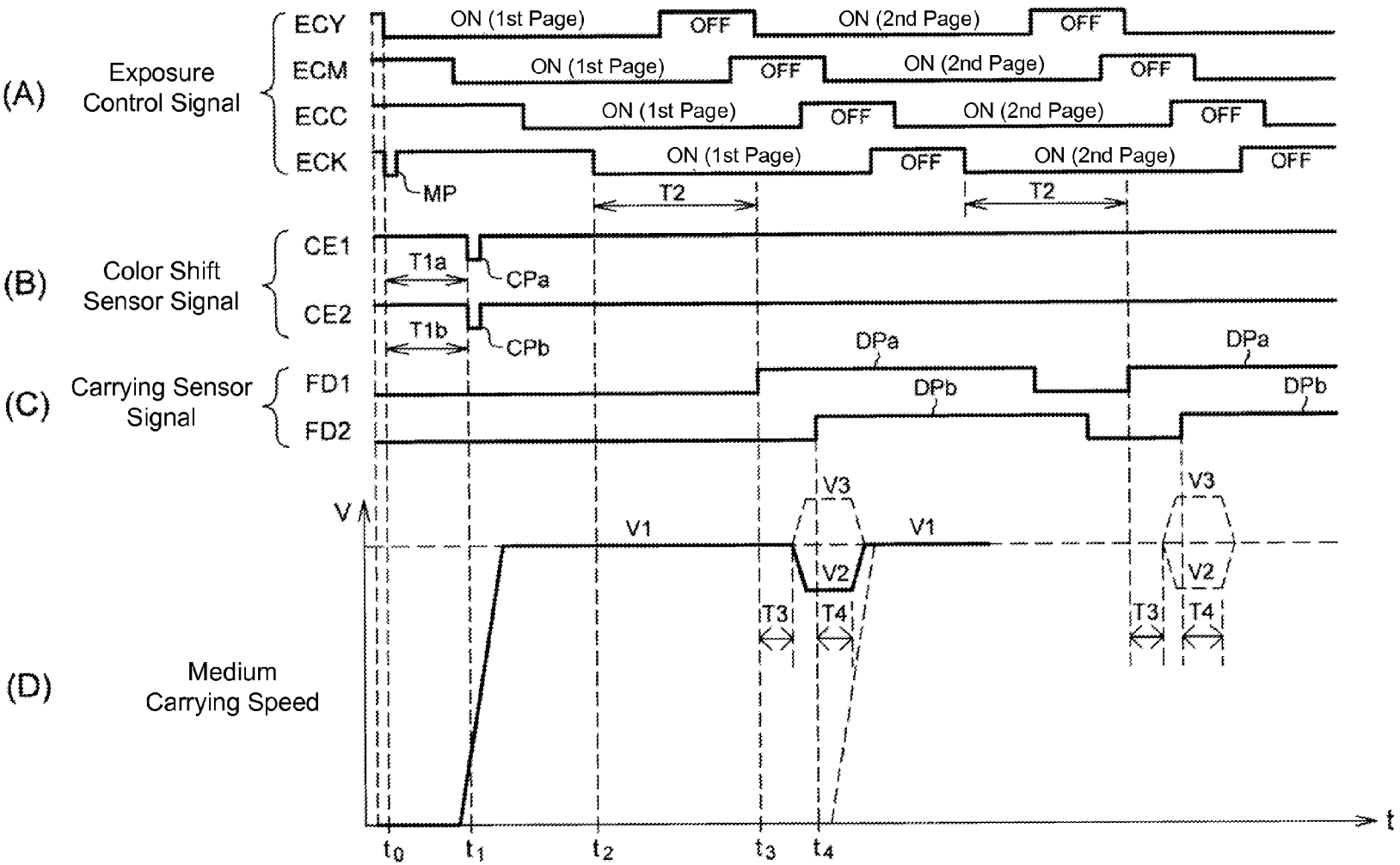
FIGS. 5A to 5D are timing charts for explaining a print operation of the image forming apparatus of the first embodiment.

Next, the LED controller 82 controls exposure operation of the LED heads 34Y, 34M, 34C and 34K by supplying exposure control signals ECY, ECM, ECC and ECK to the LED heads 34Y, 34M, 34C and 34K, respectively, as shown in FIG. 5A. The LED heads 34Y, 34M, 34C and 34K form electrostatic latent images on the surfaces of the photosensitive drums 31Y, 31M, 31C and 31K by emitting the light that corresponds to the color components of the print image to the photosensitive drums 31Y, 31M, 31C and 31K at the timing designated by the exposure control signals ECY, ECM, ECC and ECK. Here, when a signal level of the exposure control signal ECY is a low level (ON level), the LED 34Y operates and exposes the photosensitive drum 31Y. However, when the signal level of the exposure control signal ECY is a high level (OFF level), the LED head 34Y does not operate. The other photosensitive drums 31M, 31C and 31K operate similarly to the photosensitive drum 31Y in response to the signal levels of the respective exposure control signals ECM, ECC and ECK. As shown in FIG. 5A, the LED heads 34Y, 34M, 34C and 34K start the exposure operation for the print image in this order in a period from time $t_0$ to time $t_2$.

The development rollers 35Y, 35M, 35C and 35K form yellow (Y), magenta (M), cyan (C) and black (K) developer images by adhering the respective developers to the electrostatic latent images on the photosensitive drums 31Y, 31M, 31C and 31K. The primary transfer rollers 39Y, 39M, 39C and 39K transfers and superimposes the yellow (Y), magenta (M), cyan (C) and black (K) developer images on the photosensitive drums 31Y, 31M, 31C and 31K onto the transferred surface 41*a* of the intermediate transfer belt 41, upon receipt of application of the transfer bias from the power source circuit 70. As a result, the color developer image TP is formed on the intermediate transfer belt 41.

In the present embodiment, in a period during which the signal level of the exposure control signal ECY for the image forming unit 30Y is turned to the ON level, the LED controller 82 supplies the exposure control signal ECK that includes an ON level pulse MP, which does not correspond to the print image, to the image forming unit 30K (time $t_0$). As a result, in a period during which the yellow developer image is formed at the upstream side image forming unit 30Y, the downstream side image forming unit 30K forms the mark images TMa and TMb in advance of the color developer image TP for the print image.

Figure 6A:
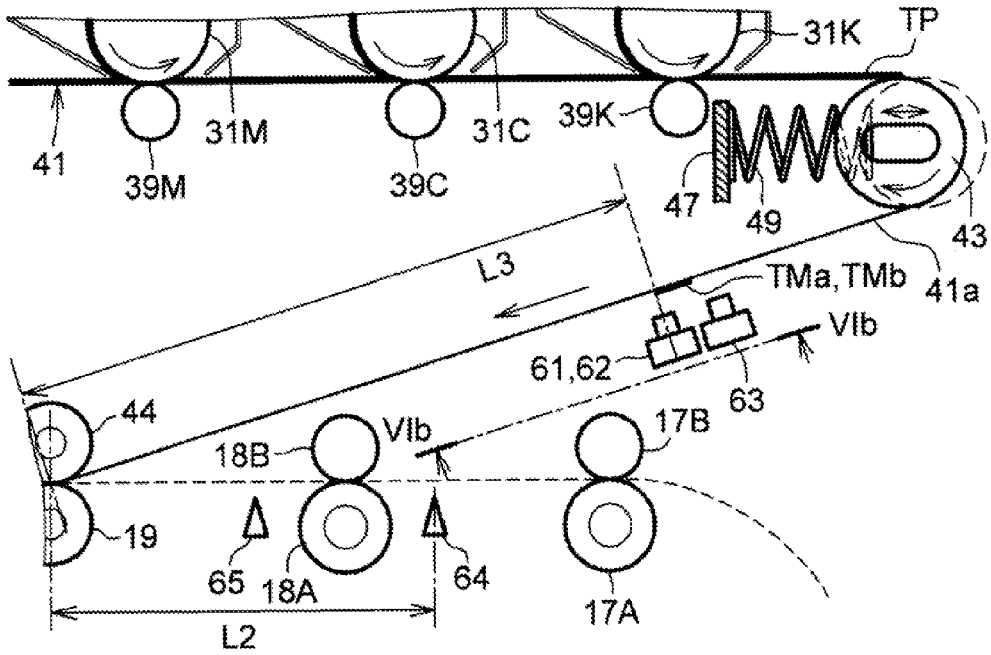
FIG. 6A is a diagram schematically illustrating mark images on an intermediate transfer belt and color developer images following the mark images in the first embodiment.
Figure 6B:
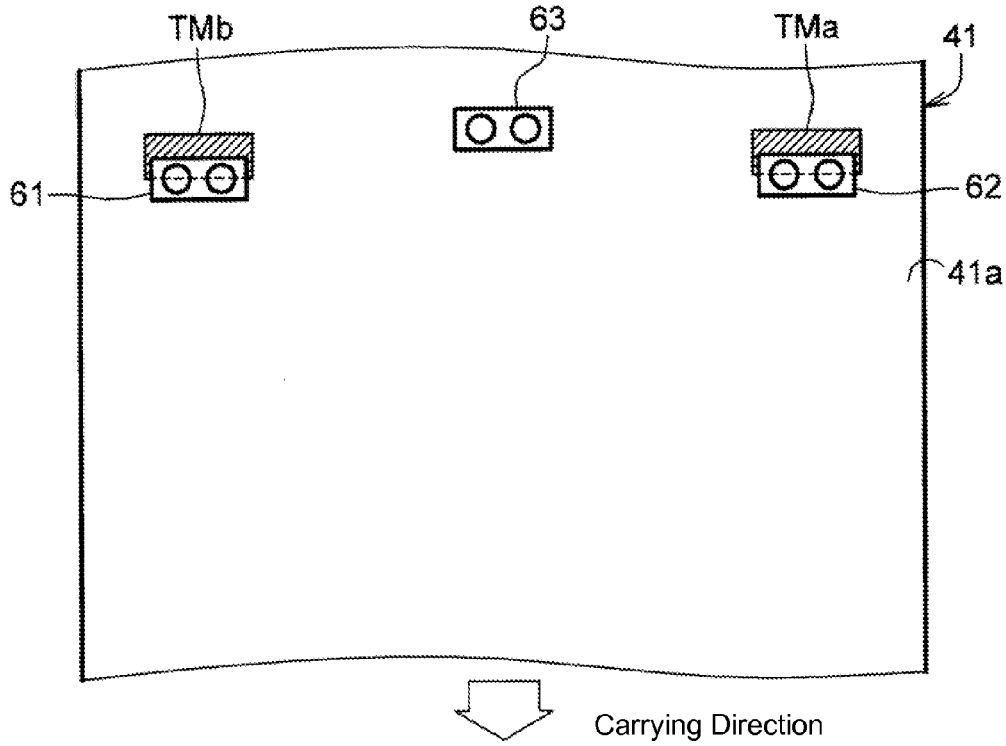
FIG. 6B is a view seen in an arrow direction along the VIb-VIb line in FIG. 6A.

The mark images TMa and TMb are carried toward the secondary transfer position after being transferred onto the intermediate transfer belt 41 at the nip part between the photosensitive drum 31K and the primary transfer roller 39. Thereafter, the first color shift sensor 61 and the second color shift sensor 62 detect the mark images TMa and TMb moving on the carrying path. FIG. 6A is a diagram schematically illustrating the mark images TMa and TMb on the intermediate transfer belt 41 and the color developer image TP following the mark images TMa and TMb. FIG. 6B is a view seen in an arrow direction along the VIb-VIb line in FIG. 6A. As shown in FIG. 6B, the mark images TMa and TMb are formed at positions where the mark images TMa and TMb respectively pass the detection areas of the first color shift sensor 61 and the second color shift sensor 62 on the transferred surface 41*a*. When the first color shift sensor 61 and the second color shift sensor 62 detect the mark images TMa and TMb, respectively, the main controller 81 detects a rising pulse CPa that indicates a result of detecting the mark image TMa from the color shift sensor signal CE1 and detects a falling pulse CPb that indicates a result of detecting the mark image TMb from the color shift sensor signal CE2 as shown in FIG. 5B (time $t_1$).

On the other hand, the carrying of the recording medium Pa starts after predetermined time elapses from the start time $t_0$ of the exposure control by the LED controller 82. FIG. 5D is a graph illustrating an example of carrying speed V (hereinafter referred to as "medium carrying speed V") of the recording medium Pa that is carried in synchronous with the exposure control. As shown in FIG. 5D, the medium carrying speed V is initially controlled to be the same speed as the drive speed of the intermediate transfer belt 41, that is, carrying speed V1 of the developer images (mark images TMa and TMb and color developer image TP) on the transferred surface 41*a*. In the case of the image forming apparatus 1 using the intermediate transfer technique as discussed in the present embodiment, a sum of a distance Lps, in which the electrostatic latent image formed at the exposure position in the image forming unit 30Y located at the most upstream side among the image forming units 30Y, 30M, 30C and 30K moves from the exposure position to the development position, and a distance Lpd, in which the developer image formed at the development position moves from the development position to the secondary transfer position (=Lps+Lpd), is generally longer than a distance in which the recording medium Pa moves from a medium take-up position in the cassette 11A to the secondary transfer position. As a result, the exposure control by the LED controller 82 is started earlier than the carrying of the recording medium Pa.

Figure 7A:
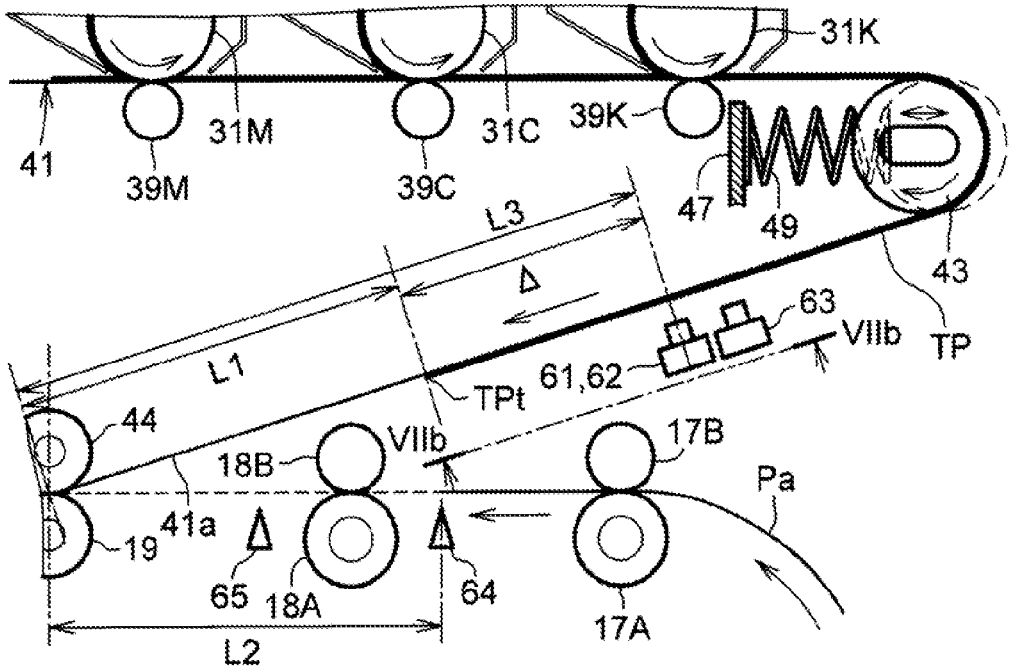
FIG. 7A is a diagram schematically illustrating a position of a color developer image on the intermediate transfer belt at the time when a first carrying sensor of the first embodiment detects the recording medium.
Figure 7B:
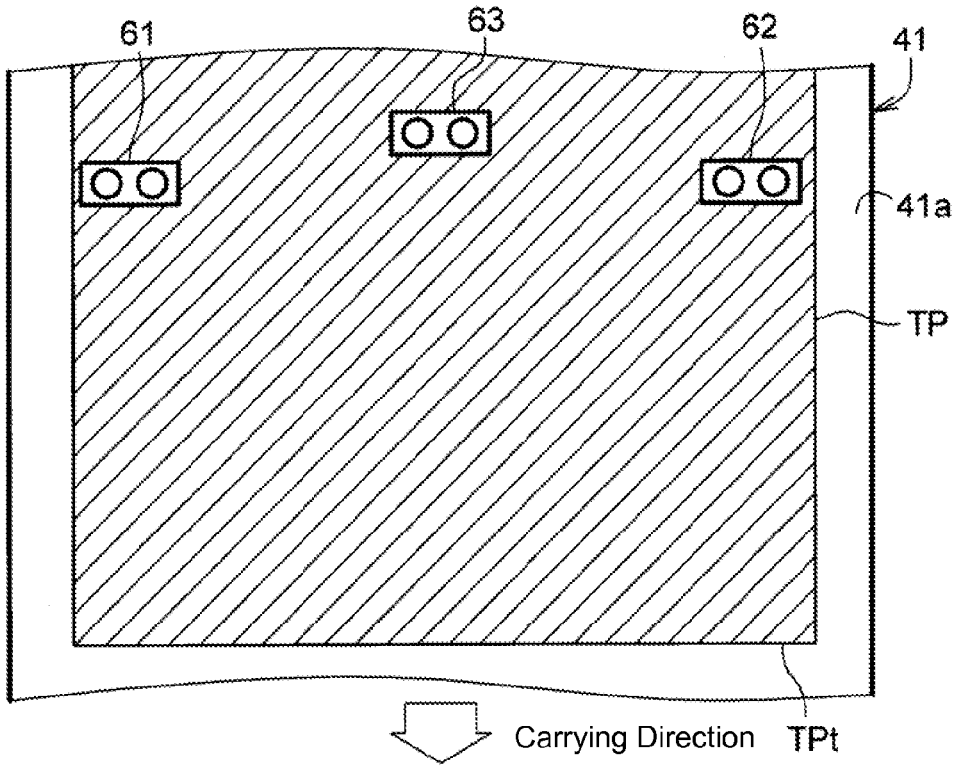
FIG. 7B is a view seen in an arrow direction along the VIIb-VIIb line in FIG. 7A.

When the first carrying sensor 64 detects the recording medium Pa moving toward the secondary transfer position, the main controller 81 detects the rising pulse DPa shown in FIG. 5C from the carrying sensor signal FD1 (time $t_3$). FIG. 7A is a diagram schematically illustrating a position of the color developer image TP on the intermediate transfer belt 41 at time $t_3$ at which the first carrying sensor 64 detects the recording medium Pa. FIG. 7B is a view seen in an arrow direction along the VIIb-VIIb line in FIG. 7A. As shown in FIG. 7A, when the carrying distance from the position of a front end TPt of the color developer image TP to the secondary transfer position is defined as L1, the following equation (1) is formed at high accuracy:

$$L3-L1=T2\times V1-T1\times V1 \quad (1)$$

In the above equation (1), T1 is time elapsed from time $t_0$, at which the electrostatic latent images that form bases of the mark images TMa and TMb are formed in the image forming unit 30K, to time $t_1$, at which the mark images TMa and TMb are detected by the first color shift sensor 61 and the second color shift sensor 62, respectively. T2 is time elapsed from time $t_2$, at which the electrostatic latent image that forms a base of the black (K) developer image is formed, to time $t_3$, at which the black (K) developer image reaches a position illustrated in FIG. 7A.

In the example shown in FIG. 6B, because there is no positional shift between the mark images TMa and TMb in the carrying direction, the first color shift sensor 61 and the second color shift sensor 62 detect the mark images TMa and TMb at the same time $t_1$. However, when there is a positional shift between the mark images TMa and TMb in the carrying direction, detection time $t_{1a}$ for the mark image TMa and detection time $t_{1b}$ for the mark image TMb differ from each other. In this case, an average value of the elapsed time T1a from the start time $t_0$ of the exposure control to the detection time $t_{1a}$ and the elapsed time T1b from the start time $t_0$ of the exposure control to the detection time $t_{1b}$, is calculated as the elapsed time T1.

Surface speed of the photosensitive drum 31K is substantially the same as the drive speed V1 of the intermediate transfer belt 41. Therefore, T1×V1 on the right side of the above equation (1) means a total distance Lm (=Lms+Lmt) of the distance Lms, in which the electrostatic latent images form the bases of the mark images TMa and TMb are carried in the elapsed time T1, and a distance Lmt in which the mark images TMa and TMb are carried. In addition, T2×V1 on the right side of the above equation (1) means a total distance Lp (=Lps+Lpt) of the distance Lps, in which the electrostatic latent image corresponding to the black component of the print image is carried in the elapsed time T2, and the distance Lpt, in which the developer image corresponding to the electrostatic lancet image is carried. Therefore, the difference between the distance Lp and the distance Lm is substantially the same as a difference Δ (=L3−L1) between the carrying distance L3 and the carrying distance L1.

By modifying the above equation (1), the following equation (2) is obtained:

$$L1=L3-(T2-T1)\times V1 \quad (2)$$

The main controller 81 predicts an expected carrying distance L1 of the developer image from the position of the developer image at time $t_3$, at which the recording medium Pa (or Pb) is detected, to the secondary transfer position, based on this equation (2) and variably controls the carrying speed V of the recording medium Pa (or Pb) based on the estimated carrying distance L1. As a result, the accuracy in positioning the color developer image TP carried toward the secondary transfer position and the recording medium Pa (or Pb) is improved.

Figure 8:
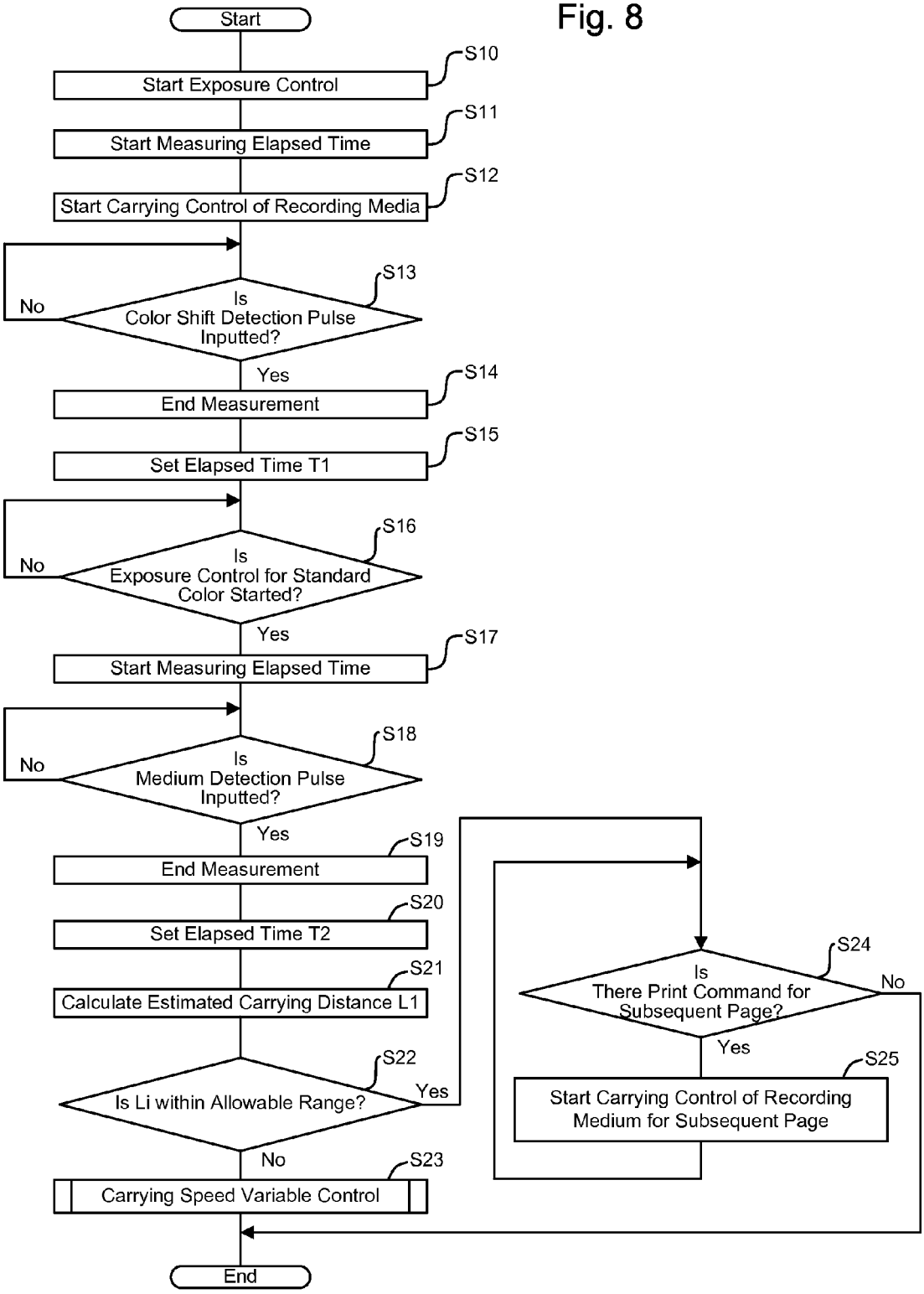
FIG. 8 is a flow diagram schematically illustrating an example of main steps of a method for controlling medium carrying speed according to the first embodiment.
Figure 9:
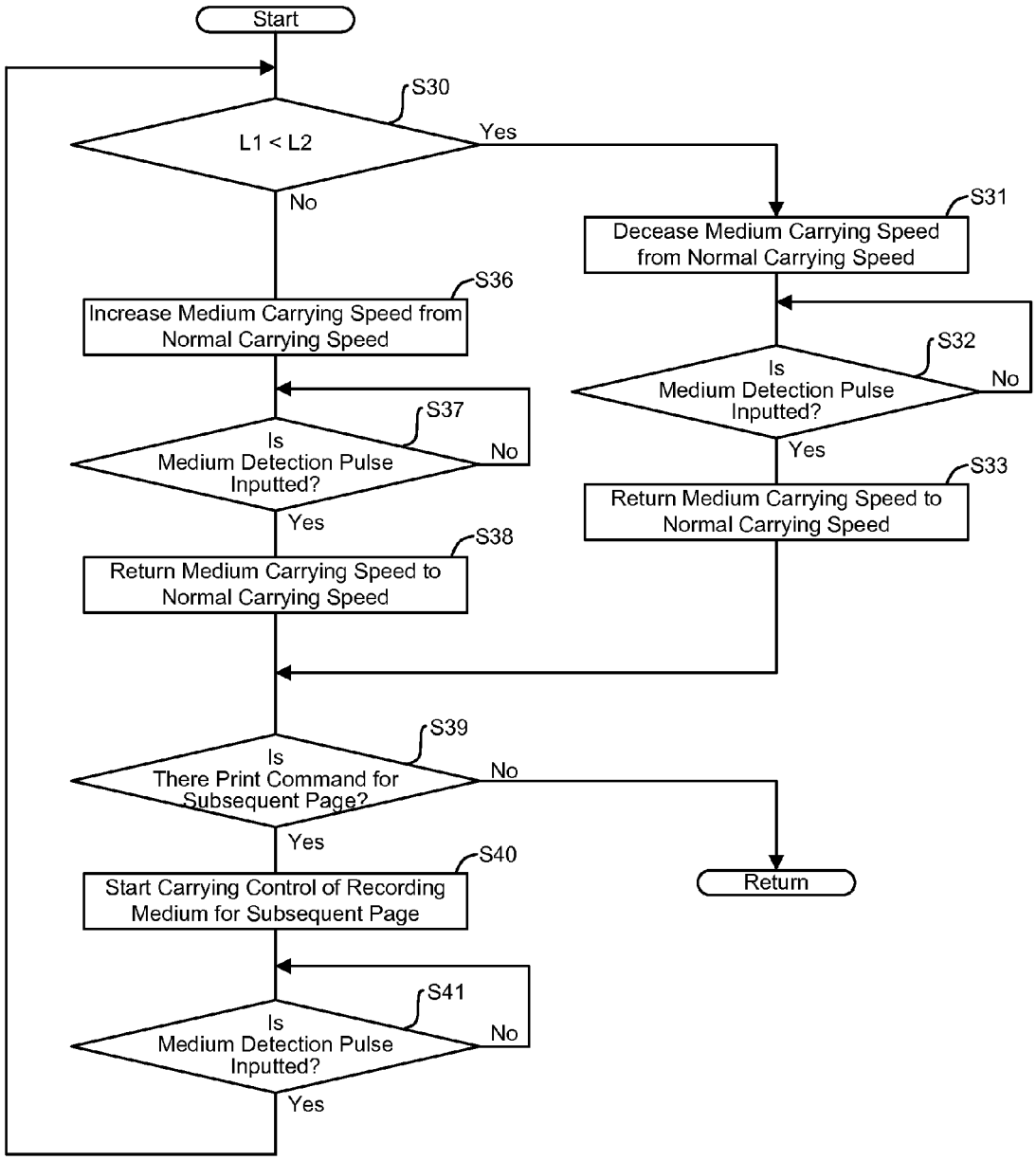
FIG. 9 is a flow diagram schematically illustrating steps of a carrying speed variable control (S23) in FIG. 8.

FIG. 8 is a flow diagram schematically illustrating an example of main steps of a control method of the medium carrying speed. FIG. 9 is a flow diagram schematically illustrating steps for a carrying speed variable control (S23) in FIG. 8. Below, the control process of the medium carrying speed V by the main controller 81 is explained with reference to FIGS. 8 and 9.

After receiving a print command, the main controller 81 instructs the LED controller 82 to start the exposure control (S10). In response to the instruction from the main controller 81, the LED controller 82 generates the exposure control signal ECY of the first page at the time $t_0$ and generates a falling pulse MP for the mark images TMa and TMb that synchronizes with the exposure control signal ECY, as shown in FIG. 5A. As a counting operation for an internal timer is started with the falling pulse MP as a trigger, the main controller 81 starts measuring the elapsed time from time $t_0$ (S11).

Next, the main controller 81 starts carrying the recording medium Pa by controlling the feeding motors 25 and 26, the registration motor 27 and the carrying motor group MT (S12). By this carrying control, the recording medium is carried toward the secondary transfer position at a constant carrying speed V1 (hereinafter referred to as "normal carrying speed V1") as shown in FIG. 5D.

Thereafter, the main controller 81 waits until color shift pulses CPa and CPb are inputted from the first color shift sensor 61 and the second color shift sensor 62 (No, S13). When the color shift detection pulses CPa and CPb shown in FIG. 5B are inputted (Yes, S13), the main controller 81 stops the measuring operation for the internal timer, and count values Na and Nb that correspond to the color shift detection pulses CPa and CPb, respectively, are obtained (S14). Next, the main controller 81 calculates an arithmetic mean value (=(T1a+T1b)/2) of the elapsed time T1a and T1b that correspond to the count values Na and Nb, respectively, and sets the elapsed time T1 to the arithmetic mean value (S15). Thereafter, the count values Na and Nb of the internal timer are initialized.

Thereafter, the main controller 81 waits until the exposure control for the standard color (black) developer image is started (No, S16). As shown in FIG. 5A, when the exposure control for the standard color developer image is started at time $t_2$, the main controller 81 starts measuring the elapsed time from time $t_2$ by stating the count operation of the internal timer (S17). Thereafter, the main controller 81 waits until the medium detection pulse (rising pulse) DPa is inputted (No, S18). As shown in FIG. 5C, when the medium detection pulse DPa is inputted at time $t_3$ (Yes, S18), the main controller 81 ends the measuring operation and obtains a count value Nc (S19). Next, the main controller 81 sets the elapsed time T2 for the time that corresponds to the count value Nc (S20). Thereafter, the count values of the internal timer are initialized.

After completing the setting of the elapsed time T1 and T2, the main controller 81 calculates the expected carrying distance L1 of the color developer image TP as shown in FIG. 7A, based on the time difference in elapsed time T1 and T2 (=T2−T1) in accordance with the above equation (2) (S21). The value of this estimated carrying distance L1 is stored in a memory. Next, whether or not this estimated carrying distance L1 is within an allowable range is determined (S22). If it is determined that the expected carrying distance L1 is within the allowable range (Yes, S22), the main controller 81 continues the carrying of the recording medium Pa to the secondary transfer position at the normal carrying speed V1 as indicated by broken lines in FIG. 5D. Thereafter, if there is no print command for the subsequent page (No, S24), the control process ends after completing the print process for the first page. In contrast, if there is a print command for the subsequent page (Yes, S24), the main controller 81 starts the carrying process of the recording medium Pa similar to the first page, in synchronous with the exposure control for the subsequent page (S25). Thereafter, the process step returns to S24.

On the other hand, if it is determined at S22 that the expected carrying distance L1 is outside the allowable range (No, S22), the main controller 81 executes the carrying speed variable control in FIG. 9 (S23).

Referring to FIG. 9, when the executed carrying distance L1 is shorter than the medium carrying distance L2 due to shrinking of the intermediate transfer belt 41 in the driving direction (Yes, S30), the main controller 81 decreases the medium carrying speed V from the normal carrying speed V1 to the speed V2 after the waiting T3 has elapses from the time $t_3$ shown in FIG. 5D (S31). Thereafter, the main controller 81 waits until the medium detection pulse (rising pulse) DPb is inputted (No, S32). When the medium detection pulse DPb is inputted (Yes, S32), the main controller 81 returns from the speed V2 to the normal carrying speed V1 by accelerating the medium carrying speed V after the waiting time T4 has elapsed from the detection time $t_4$ of the medium detection pulse DPb, with the medium detection pulse DPb as a trigger, as shown in FIG. 5D (S33). As a result, the accuracy in positioning the recording medium Pa and the color developer image TP at the secondary transfer position improves.

In contrast, when the expected carrying direction L1 is longer than the medium carrying distance L2 due to extension of the intermediate transfer belt 41 in the driving direction (No, S30), the main controller 81 increases the medium carrying speed V from the normal carrying speed V1 to speed V3 after the waiting time T3 has elapsed from the time $t_3$ as indicated by broken lines in FIG. 5D (S36). Thereafter, the main controller 81 waits until the medium detection pulse (rising pulse) DPb is inputted (No, S37). When the medium detection pulse DPb is inputted (Yes, S37), the main controller 81 returns the medium carrying speed V from the speed V3 to the normal carrying speed V1 after the waiting time T4 has elapsed from the detection time $t_4$ as indicated by broken lines in FIG. 5D, with the medium detection pulse DPb as a trigger (S38). As a result, the accuracy in positioning the recording medium Pa and the color developer image TP at the secondary transfer position is improved.

After S33 or S38, if there is no print command from the subsequent page (No, S39), the control process ends after completing the print process for the first page. On the other hand, if there is a print command for the subsequent page (Yes, S39), the main controller 81 starts the carrying control of the recording medium Pa similar to the first page in synchronous with the exposure control for the subsequent page (S40). Thereafter, the main controller 81 waits until the medium detection pulse (rising pulse) DPa is inputted (No, S41). As shown in FIG. 5D, the steps after S30 is repeatedly executed when the medium detection pulse DPa as shown in FIG. 5D is inputted (Yes, S41). Therefore, the accuracy in positioning the recording medium Pa and the color developer image TP at the secondary transfer position for a plurality of pages is improved.

The high voltage power source 72 in FIG. 2 applies to the secondary transfer roller 19 a transfer bias having opposite polarity from the polarity of the electric charge charged on the color developer image TP, at the timing when the front end of the recording medium Pa reaches the secondary transfer position. In contrast, when the mark images TMa and TMb pass the secondary transfer position, the high voltage power source 72 applies to the secondary transfer roller 19 having the same polarity as the electric charge charged on the mark images TMa and TMb in order to prevent the secondary transfer roller 19 from being contaminated by the mark images TMa and TMb. In addition, as shown in FIG. 3, the mark images TMa and TMb that is not transferred and remains on the intermediate transfer belt 41 is removed by the cleaning member 48.

Next, effects of the image forming apparatus 1 of the above-described first embodiment are explained.

As discussed above, the image forming apparatus 1 of the present embodiment detects the mark images TMa and TMb moving on the carrying math from the primary transfer position to the secondary transfer position of the image forming unit 30K and variably control the carrying speed V of the recording medium Pa (or Pb) based on the detection result. Therefore, the accuracy in positioning between the recording medium Pa (or Pb) and the color developer image TP carried subsequently after the mark images TMa and TMb. For example, when there is a fluctuation or a change in the circumferential length of the intermediate transfer belt 41 based by aging or environmental changes or when the center position of the movable idle roller 43 shifts, the carrying distance of the color developer image TP from the primary transfer position to the secondary transfer position may change. However, the image forming apparatus 1 of the present embodiment compensates such change in the carrying distance of the color developer image TP.

As shown in FIG. 7A, the main controller 81 predicts the expected carrying distance L1 from the front end TPt of the color developer image TP to the secondary transfer position at the time $t_3$ (FIG. 5C) when the recording medium Pa is detected by the first carrying sensor 64 (S21 in FIG. 8) and variably controls the medium carrying speed V in response to the expected carrying distance L1. Thus, the medium carrying speed V is controlled flexibly and with small steps. Therefore, positioning the color developer image TP and the recording medium Pa (or Pb) that meet that the secondary transfer position is extremely accurately performed.

In addition, the image forming unit 30K located on the downstream side among the image forming units 30Y, 30M, 30C and 30K forms the mark images TMa and TMb. Thus, formation of the mark images TMa and TMb does not delay the time in which the color developer image TP is transferred from the intermediate belt 41 to the recording medium Pa after receiving the print command. In other words, because the series of image formation operations related to a print job includes the operation to form the mark images TMa and TMb, delay in the image formation operation due to forming the mark images TMa and TMb is prevented. Therefore, highly accurate positioning is achieved without sacrificing first print time (time for the first recording medium to be ejected from the image forming apparatus 1 after receiving the print command).

In the present embodiment, the image forming unit 30K arranged most downstream side of the image forming units 30Y to 30K forms the mark images TMa and TMb during the period in which the image forming unit 30Y arranged most upstream side forms a developer image. However, the operation is not limited to this. Either the downstream side image forming units 30M and 30C may form the mark images TMa and TMb during the period in which the image forming unit 30Y forms a developer image. In that case also, because the formation operation of the mark images TMa and TMb is included in the series of image formation operation related to a print job, highly accurate positioning is achieved without sacrificing the first print time. However, it is preferable that the most downstream side image forming unit 30K forms the mark images TMa and TMb.

The image forming unit 30K that forms the mark images TMa and TMb are arranged at a position away from the drive roller 42. Therefore, there is an advantage that, even if the mark images TMa and TMb are formed immediately after starting the driving by the drive roller 42, vibration transmitted from the drive roller 42 to the intermediate transfer belt 41 immediately after starting the drive is hardly affected. Therefore, formation positions of the mark images TMa and TMb improves, and thus, the accuracy in compensating the medium carrying speed V also improves. Moreover, positioning with small errors is accomplished by forming the mark images TMa and TMb by using the image forming unit 30K that forms the black developer image, which is the standard color at the time of correcting color shift.

Even if either one of the image forming units 30M and 30C forms the mark images TMa and TMb, the vibration transmitted from the drive roller 42 to the intermediate belt 41 is hardly affected because the image forming units 30M and 30C are separated from the drive roller 42 via the image forming unit 30Y. Therefore, even in this case, improvement in accuracy for the formation positions of the mark images TMa and TMb and improvement in correction accuracy for the medium carrying speed V are achieved. However, it is preferable that the image forming unit 30K that is the most remote from the drive roller 42 among the image forming units 30Y to 30K form the mark images TMa and TMb.

Further, because the correction operation for the medium carrying speed V is included in the print job, unnecessary drive operation fro the photosensitive drums 31Y, 31M, 31C and 31K and unnecessary driving of the intermediate transfer belt 41 need not be performed. As a result, life of the photosensitive drums 31Y, 31M, 31C and 31K and the intermediate transfer belt unit 40 is extended.

Furthermore, in the above-described embodiment, the mark images TMa and TMb are detected by two color shift sensors: the first color shift sensor 61 and the second color shift sensor 62. As a result, even when the formation positions (transfer positions) of the mark images TMa and TMb are mutually shifted in the carrying direction (subscan direction) due to inclination of the image forming unit 30K, for example, the shifted formation positions are compensated. Therefore, the expected carrying distance L1 is accurately predicted. However, the present invention is not limited to this, and a detection result by either one of the color shift sensor may be used.

Second Embodiment

Next, a second embodiment according to the present invention is explained. A basic configuration of the image forming apparatus of the present embodiment is the same as the basic configuration of the image forming apparatus 1 of the first embodiment shown in FIGS. 1 to 3. In the present embodiment, the density sensor 63 configures a developer image detection part that detects the mark image moving on the carrying path, not the first color shift sensor 61 or the second color shift sensor 62. Except this point, the control method of the medium carrying speed of the present embodiment is substantially the same as the control method of the medium carrying speed of the first embodiment.

FIGS. 10A to 10D illustrate timing charts for explaining the print operation of the image forming apparatus of the present embodiment. Similar to the case of the above-descried first embodiment, when the print operation starts, the main controller 81 starts rotating the belt driving motor 45 and the drum motors DMY, DMM, DMC and DMK. As a result, intermediate transfer belt 41 and the photosensitive drums 31Y, 31M, 31C and 31K are driven. Moreover, the development controller 84 causes the charge rollers 32Y, 32M, 32C and 32K to perform the charging operation.

Figure 10:
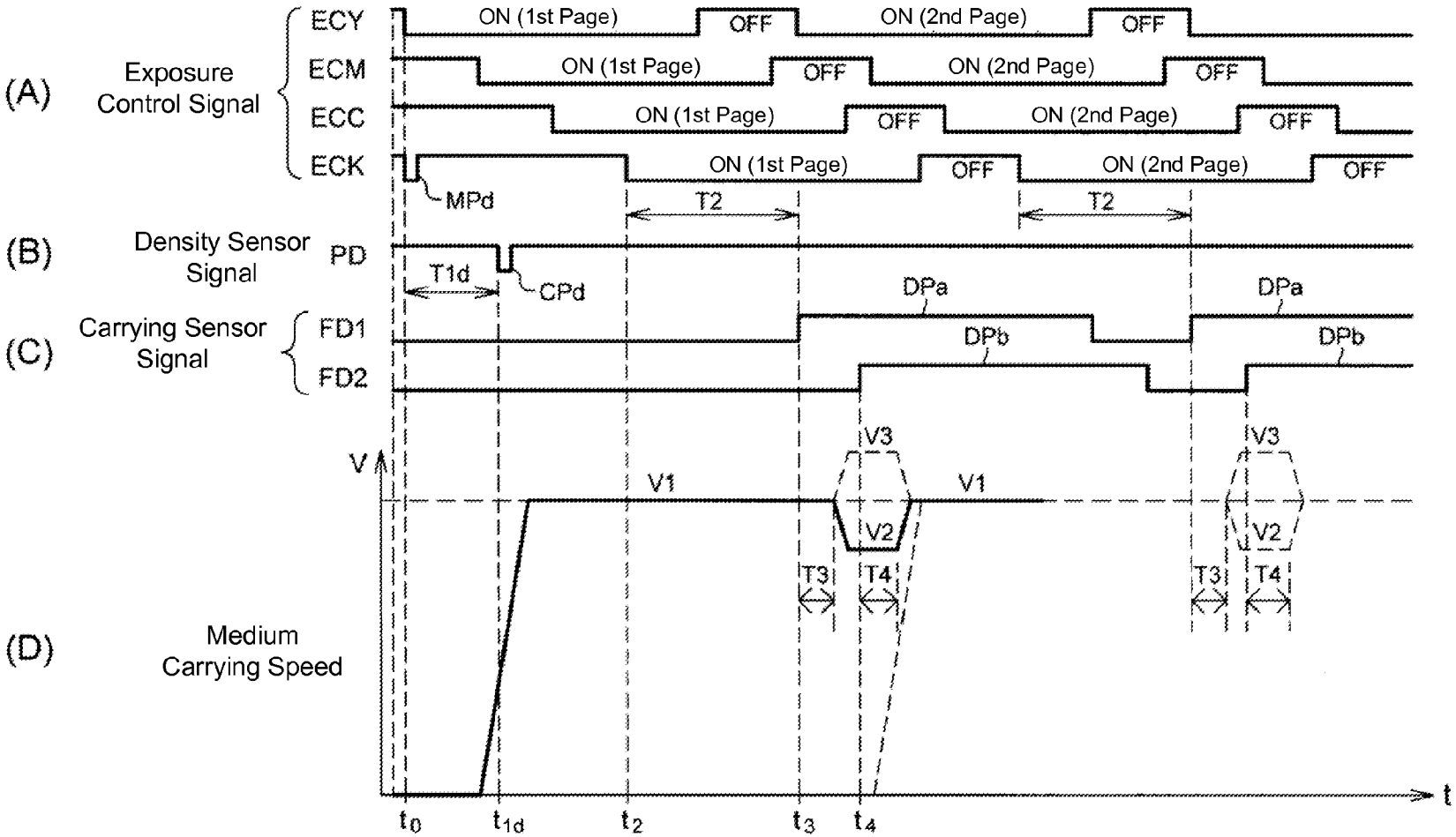
FIGS. 10A to 10D are timing charts for explaining a print operation of the image forming apparatus of a second embodiment.

Next, the LED controller 82 controls the exposure operation of the LED heads 34Y, 34M, 34C and 34K by supplying the exposure control signals ECY, ECM, ECC and ECK as shown in FIG. 10A to the LED heads 34Y, 34M, 34C and 34K, respectively. Signal waveforms of the exposure control signals ECY, ECM, ECC and ECK shown in FIG. 10A are the same as the waveforms shown in FIG. 5A.

Moreover, in the period during which the signal level of the exposure control signal ECY for the image forming unit 30Y is turned to the ON level, the LED controller 82 supplies the exposure control signal ECK that includes an ON level pulse MPd to the image forming unit 30K (time $t_0$). As a result, a mark image TMd is formed by the image forming unit 30K and is transferred onto the intermediate transfer belt 41. The mark image TMd is detected by the density sensor 63 when the mark image TMd moves on the carrying path toward the secondary transfer position.

Figure 11A:
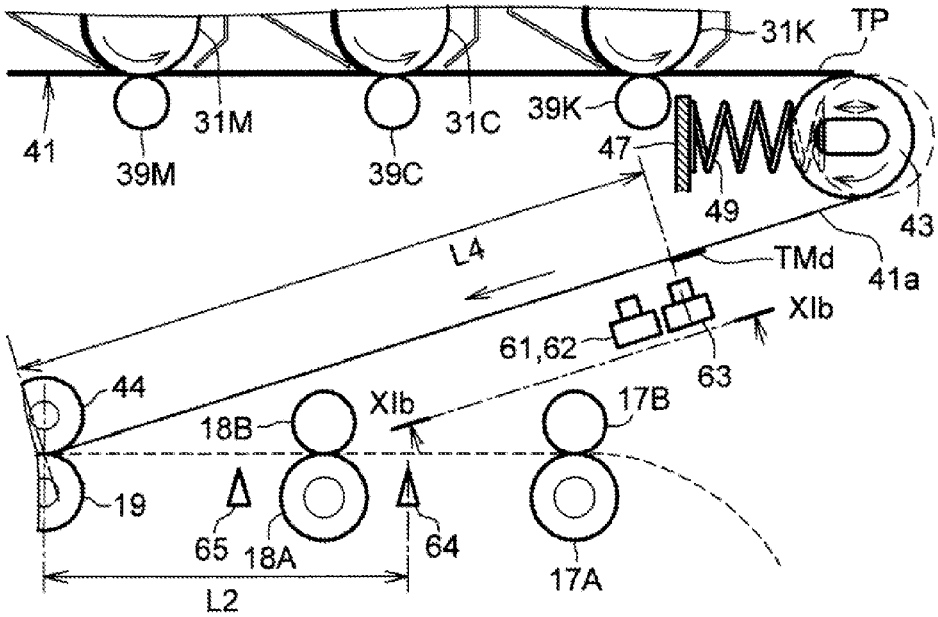
FIG. 11A is a diagram schematically illustrating a mark image on the intermediate transfer belt and a color developer image following the mark images in the second embodiment.
Figure 11B:
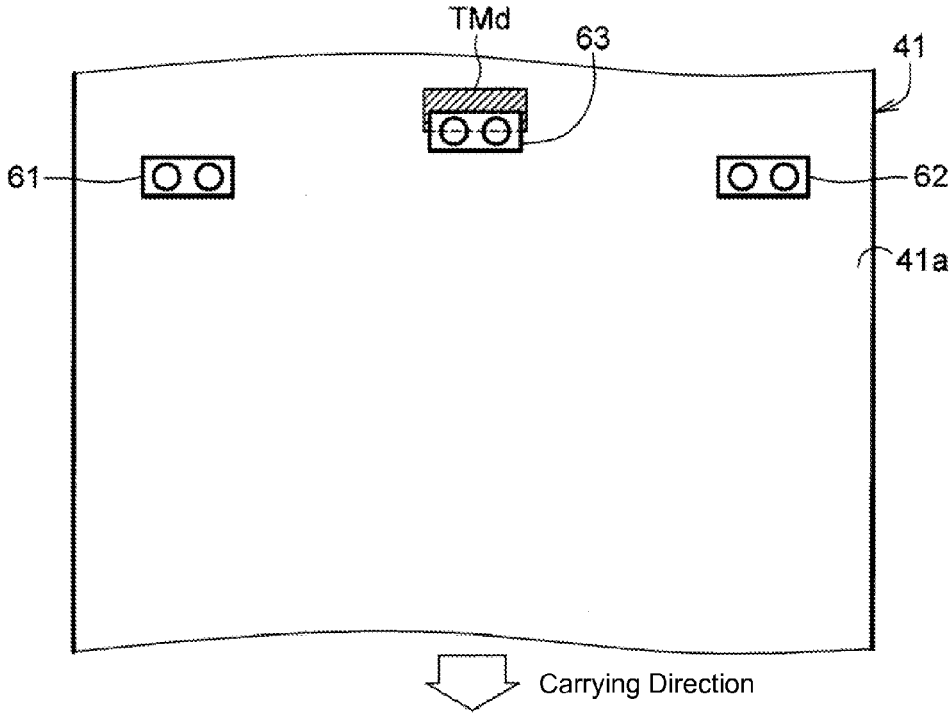
FIG. 11B is a view seen in an arrow direction along the XIb-XIb line in FIG. 11A.

FIG. 11A is a diagram schematically illustrating the mark image TMd on the intermediate transfer belt 41 and the color developer image TP following the mark image TMd. FIG. 11B is a view seen in an arrow direction along the XIb-XIb line in FIG. 11A. As shown in FIG. 11B, the mark image TMd is formed at a position on the transferred surface 41*a* where the mark image TMd passes a detection region of the density sensor 63. As shown in FIG. 10B, when the density sensor 63 detects the mark image TMd, the main controller 81 detects from a density sensor signal PD a falling pulse CPd that indicates a detection result of the mark image TMd (time $t_{1d}$).

Meanwhile, carrying of the recording medium Pa is started after predetermined time has elapsed from the starting time $t_0$ of the exposure control by the LED controller 82. FIG. 10D is a graph illustrating an example of the carrying speed V (hereinafter referred to as "medium carrying speed V") of the recording medium Pa carried in synchronous with the exposure control. As shown in FIG. 10D, the medium carrying speed V is controlled to be initially the same speed as the driving speed of the intermediate transfer belt 41, that is, the carrying speed V1 of the developer image (mark image TMd and color developer image TP) on the transferred surface 41*a*.

Figure 12A:
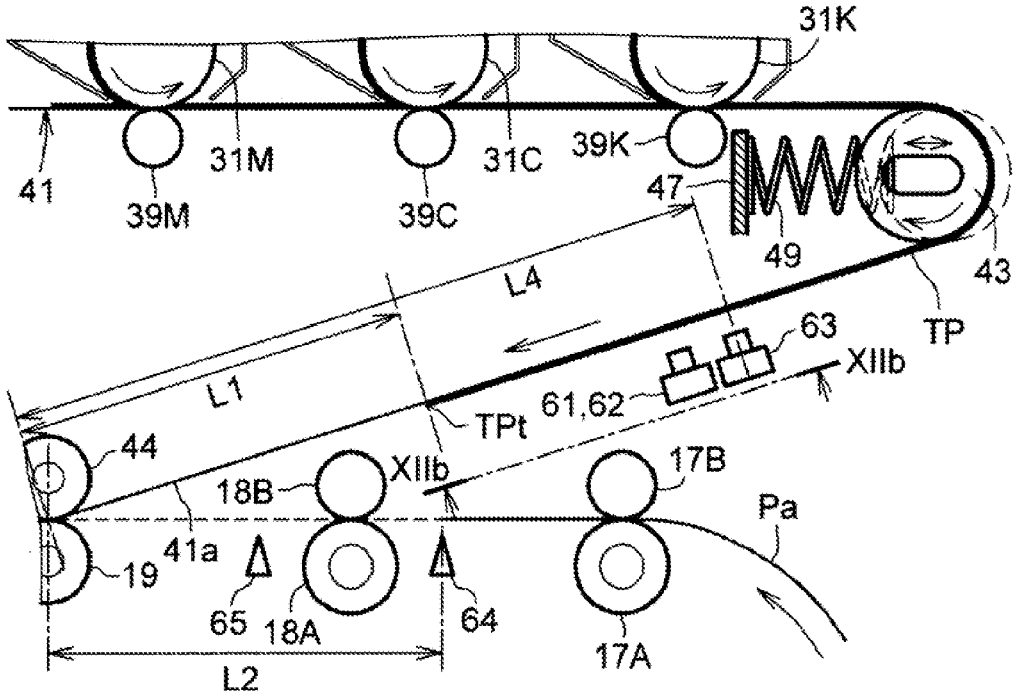
FIG. 12A is a diagram schematically illustrating a position of a color developer image on the intermediate transfer belt at the time when a density sensor of the second embodiment detects the recording medium.
Figure 12B:
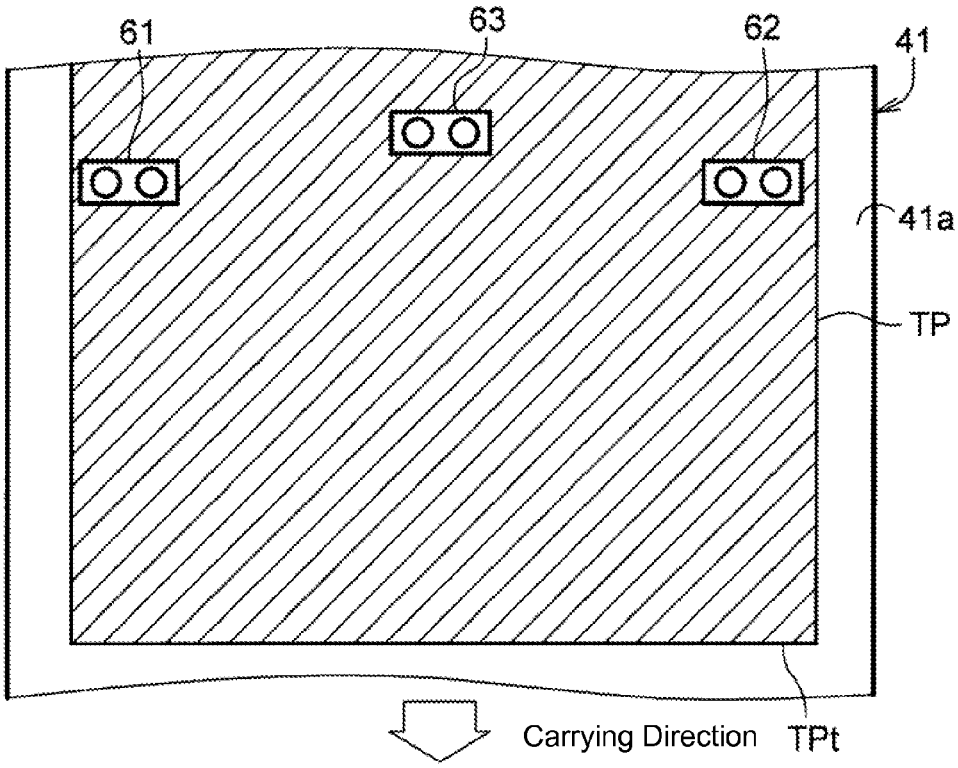
FIG. 12B is a view seen in an arrow direction along the XIIb-XIIb line in FIG. 12A.

When the first carrying sensor 64 detects the recording medium Pa moving towards the secondary transfer position, the main controller 81 detects the rising pulse DPa shown in FIG. 10C from a carrying sensor signal FD1 (time $t_3$). FIG. 12A is a diagram schematically illustrating a position of the color developer image TP on the intermediate transfer belt 41 at time $t_3$ at which the first carrying sensor 64 detects the recording medium Pa. FIG. 12B is a view seen in an arrow direction along the XIIb-XIIb line in FIG. 12A. As shown in FIG. 12A, when the carrying distance from the position of a front end TPt of the color developer image TP to the secondary transfer position is defined as L1, the following equation (3) is formed at high accuracy similar to the above equation (1):

$$L4-L1=T2\times V1-T1d\times V1 \tag{3}$$

In the above equation (3), L4 is a carrying distance of the developer image from a facing position on the transferred surface 41 facing the center of the density sensor 63 to the secondary transfer position. As shown in FIG. 12A, this carrying distance L4 is longer than the carrying distance from the idle roller 43 to the facing position and does not substantially change even during the print operation of the image forming apparatus 1. In addition, T1d is elapsed time from the time $t_0$ at which an electrostatic latent image that is a base of the mark image TMd is formed in the image forming unit 30K, to the time $t_{1d}$ at which the mark image TMd is detected by the density sensor 63. T2 is elapsed time from time $t_2$, at which an electrostatic latent image that is a base of the black (K) developer image is formed in the image forming unit 30K, to time $t_3$, at which the black (K) developer image reaches a position illustrated in FIG. 12A.

By modifying the above equation (3), the following equation (4) is obtained:

$$L1=L4-(T2-T1d)\times V1 \tag{4}$$

The main controller 81 predicts an expected carrying distance L1 for the developer image from the position of the developer image at time $t_3$, at which the recording medium Pa is detected, to the secondary transfer position, based on this equation (4) and variably controls the carrying speed V of the recording medium Pa based on the estimated carrying distance L1. As a result, the accuracy in positioning the color developer image TP carried toward the secondary transfer position and the recording medium Pa is improved.

Figure 13:
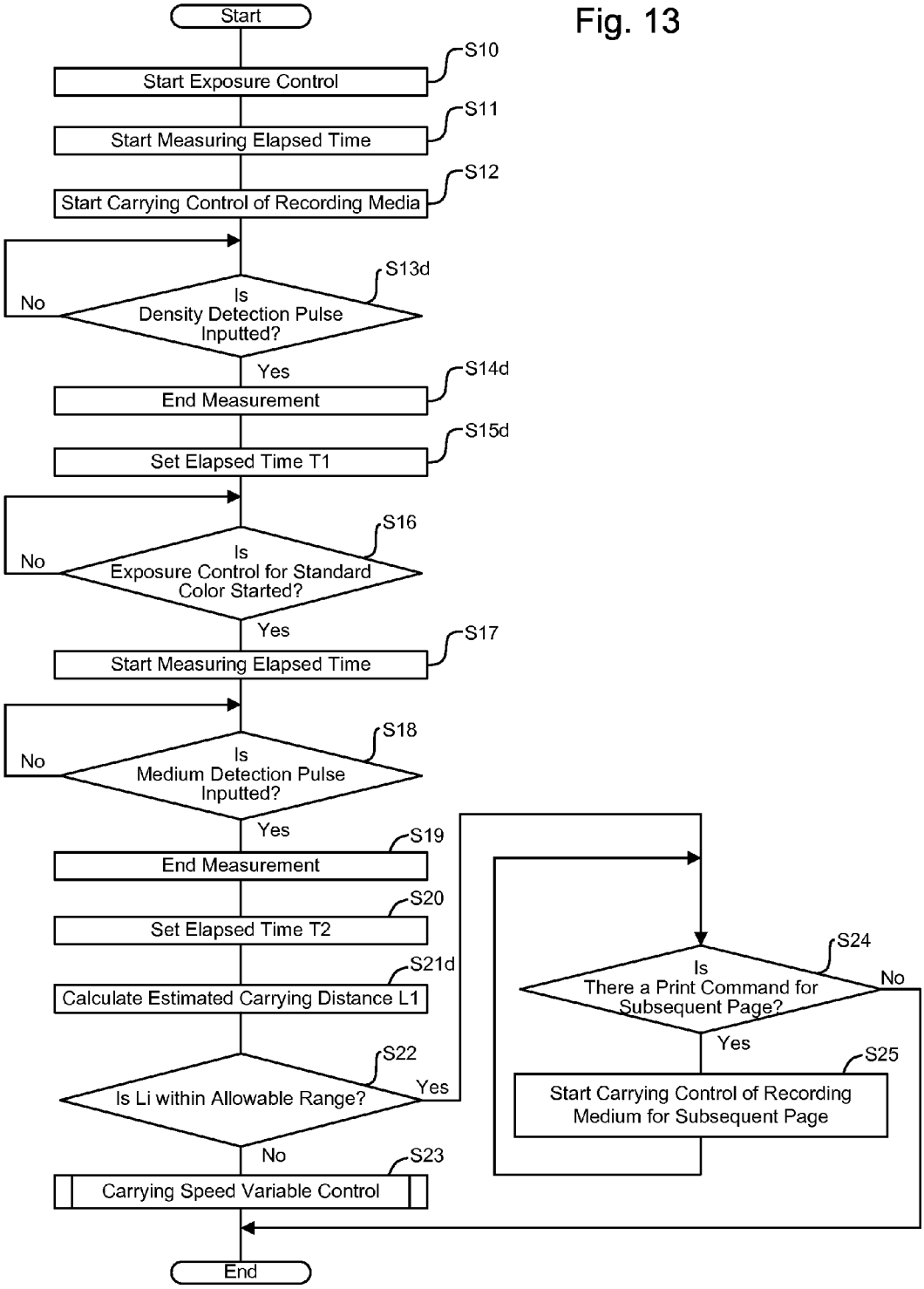
FIG. 13 is a flow diagram schematically illustrating main steps of the carrying speed variable control according to the second embodiment.

Below, a control process of the medium carrying speed according to the second embodiment is explained with reference to FIG. 13. FIG. 13 is a flow diagram schematically illustrating an example of main steps of the control method of the medium carrying speed according to the second embodiment.

The steps of this flow diagram are the same as the above-described flow diagram in FIG. 8, except S13*d*, S14*d*, S15*d* and S21*d*.

The main controller 81 waits until a density detection pulse (rising pulse) CPd (No, S13*d*) after executing S10 to S12 similar to the first embodiment. When the density detection pulse CPd as shown in FIG. 10B is inputted (Yes, S13*d*), the main controller 81 stops the counting operation of the internal timer and obtains a count value Nd that corresponds to the density detection pulse CPd (S14*d*). Next, the main controller 81 sets the elapsed time T1d that corresponds to the count value Nd (S15*d*). Thereafter, the count value Nd of the internal timer is initialized.

Thereafter, after executing S16 to S20 similarly to the first embodiment, the main controller 81 calculates the expected carrying distance L1 of the color developer image TP based on a time difference of the elapsed time T1d and T2 (=T2–T1d) in accordance with the above equation (4) (S21*d*). The value of this expected carrying distance L1 is stored in a memory. Thereafter, the main controller 81 execute S23, or S25 and S26, similarly to the first embodiment, in response to whether or not the expected carrying distance L1 is within the allowable range (S22).

As explained above, in the second embodiment, the density sensor 63 detects the mark image TMd that move from the primary transfer position toward the secondary transfer position, and the main controller 81 variably control the carrying speed V of the recording medium Pa (or Pb) based on the detection result of the density sensor 63. In addition, similar to the case of the first embodiment, the main controller 81 predicts the expected carrying distance L1 of the color developer image TP (S21*d* in FIG. 13) and variably controls the medium carrying speed Vin response to this expected carrying distance L1. Thus, the medium carrying speed V is controlled flexibly and at small steps. Therefore, positioning the color developer image TP and the recording medium Pa (or Pb) that meet that the secondary transfer position is extremely accurately performed.

Moreover, in the present embodiment, unlike the case of the above-described first embodiment, only one mark image TMd that is detected by the density sensor 63 is formed. As a result, there is an advantage that the amount of developer consumed is suppressed. In addition, because the mark image TMd is formed at an approximately center position of the transferred surface 41*a* in the width direction in correspondence with the detection region of the density sensor 63, generally inclination of the image forming unit 30K is not affected. Therefore, accuracy in positioning between the color developer image TP and the recording medium Pa (or Pb) at the secondary transfer position is improved.

Various embodiments of the present invention are discussed above. However, the embodiments are examples of the present embodiment, and various embodiments other than those discussed above may be adapted. For example, the entire or a part of the configuration of the controller 80 may be achieved by hardware or a program that executes the process at a processor, such as a central processing unit (CPU). Alternatively, the controller 80 may be configured from an application specific integrated circuit (ASIC), which is an integrated circuit integrating circuits of a plurality of functions for specific usage, or a field programmable gate array (FPGA), which allows the user to write unique logical circuits.

The present invention may be implemented in image forming apparatuses, such as photocopy machines, facsimile machines, printers and the like that adapts the intermediate transfer technique.

What is claimed is:

1. An image forming apparatus, comprising:

a developer image forming part that is configured to form a developer image;

an intermediate transfer body that is configured to hold and carry the developer image that is transferred from the developer image forming part to a transferred surface thereof;

a primary transfer part that is configured to transfer the developer image from the developer image forming part to the transferred surface at a primary transfer position;

a drive mechanism that is configured to drive the intermediate transfer body to carry the developer image on the transferred surface on a carrying path that is defined from the primary transfer position to a secondary transfer position located on a downstream side of the primary transfer position in a driving direction of the intermediate transfer body;

a medium carrying mechanism that is configured to carry a medium to the secondary transfer position;

a secondary transfer part that is configured to transfer the developer image from the intermediate transfer body to the medium at the secondary transfer position;

a developer image detection part that is configured to detect the developer image on the intermediate transfer body; and a drive controller that is configured to control an operation of the medium carrying mechanism, wherein the developer image forming part forms a mark developer image, the primary transfer part transfers the mark developer image from the developer image forming part to the transferred surface of the intermediate transfer body, the drive mechanism drives the intermediate transfer body to carry the mark developer image on the transferred surface along the carrying path, the developer image detection part detects the mark developer image moving on the carrying path, and the drive controller varies a carrying speed of the medium from a first speed to a second speed and then varies the carrying speed from the second speed to the first speed, based on a detection result of the mark developer image by the developer image detection part.

2. The image forming apparatus of claim 1, further comprising:

a medium detection sensor that is configured to detect the medium moving on a medium carrying path from a predetermined position to the secondary transfer position, wherein the drive controller calculates an estimated carrying distance of the developer image, the estimated carrying distance being from a position of the developer image at the time when the medium is detected by the medium detection sensor to the secondary transfer position, based on a detection result by the developer image detection part and a detection result by the medium detection sensor, and the drive controller varies the carrying speed based on the estimated carrying distance.

3. The image forming apparatus of claim 2, wherein the drive controller calculates the estimated carrying distance based on a time difference between the time during which the mark developer image is carried until the mark developer image is detected by the developer image detection part, and the time during which the developer image is carried until the medium is detected by the medium carrying sensor.

4. The image forming apparatus of claim 1, wherein the intermediate transfer body is made from a sheet-shaped elastic member, and the drive mechanism includes a tension member that supports and tensions the intermediate transfer body between the primary transfer position and the secondary transfer position.

5. The image forming apparatus of claim 4, wherein the drive mechanism further includes an elastic member that biases the tension member in a predetermined direction and provides tension to the intermediate transfer body.

6. The image forming apparatus of claim 4, wherein the tension member includes:

a drive roller that is configured to drive the intermediate transfer body; and a driven roller that is arranged in the vicinity of the carrying path from the primary transfer position to the secondary transfer position, and the drive roller is arranged on an upstream side from the driven roller in the driving direction of the intermediate transfer body.

7. The image forming apparatus of claim 6, wherein the developer image detection part is arranged in the vicinity of the carrying path and on a downstream side from the drive roller in the driving direction.

8. The image forming apparatus of claim 1, wherein the developer image forming part includes a plurality of image forming units that are configured to form a plurality of images formed from mutually different colors of developers as the developer image, the primary transfer part includes a plurality of transfer members on which the plurality of images are transferred from the plurality of image forming units onto the transferred surface of the intermediate transfer body and the plurality of images are superimposed, the plurality of image forming units are arranged in the driving direction of the intermediate transfer body, one of the plurality of image forming units is a first image forming unit, and the first image forming unit forms both the mark developer image and the developer image.

9. The image forming apparatus of claim 8, wherein the first image forming unit is arranged on the most downstream side among the plurality of image forming units in the driving direction of the intermediate transfer body.

10. The image forming apparatus of claim 9, wherein the drive mechanism includes:

a drive roller configured to drive the intermediate transfer body; and a driven roller arranged in the vicinity of the carrying path, the intermediate transfer body is a sheet-shape elastic member tensioned over the drive roller and the driven roller, and the drive roller is arranged on an upstream side from the plurality of image forming units in the driving direction.

11. The image forming apparatus of claim 9, wherein the first image forming unit is configured to form a color image that is a reference for correcting color shift among the plurality of images.

12. The image forming apparatus of claim 8, wherein another of the plurality of image forming units is a second image forming unit, the second image forming unit is arranged at the most upstream side in the driving direction of the intermediate transfer body, and the first image forming unit is configured to form the mark developer image within a period in which the second image forming unit forms the image.

13. The image forming apparatus of claim 1, wherein the developer image detection part is an optical sensor used for correcting color shift.

14. The image forming apparatus of claim 1, wherein the developer image detection part is arranged at a position facing an approximately center position of the transferred surface in a width direction.

15. The image forming apparatus of claim 14, wherein the developer image detection part is an optical sensor used for measuring density of the developer image.

16. The image forming apparatus of claim 1, wherein the second speed is slower than the first speed.

17. The image forming apparatus of claim 1, wherein the second speed is faster than the first speed.

18. The image forming apparatus of claim 1, further comprising:

a medium detection sensor that is configured to detect the medium moving on a medium carrying path from a predetermined position to the secondary transfer position, wherein the drive controller varies the carrying speed based on a detection result by the developer image detection part and a detection result by the medium detection sensor.

19. An image forming apparatus, comprising:

a developer image forming part that is configured to form a developer image;

an intermediate transfer body that is configured to hold and carry the developer image that is transferred from the developer image forming part to a transferred surface thereof;

a primary transfer part that is configured to transfer the developer image from the developer image forming part to the transferred surface at a primary transfer position;

a drive mechanism that is configured to drive the intermediate transfer body to carry the developer image on the transferred surface on a carrying path that is defined from the primary transfer position to a secondary transfer position located on a downstream side of the primary transfer position;

a medium carrying mechanism that is configured to carry a medium to the secondary transfer position;

a secondary transfer part that is configured to transfer the developer image from the intermediate transfer body to the medium at the secondary transfer position;

a developer image detection part that is configured to detect the developer image on the intermediate transfer body;

a drive controller that is configured to control an operation of the medium carrying mechanism; and first and second carrying sensors that are configured to detect the medium passing thereby, wherein the developer image forming part forms a mark developer image, the primary transfer part transfers the mark developer image from the developer image forming part to the transferred surface of the intermediate transfer body, the drive mechanism drives the intermediate transfer body to carry the mark developer image on the transferred surface along the carrying path, the developer image detection part detects the mark developer image moving on the carrying path, the drive controller controls carrying of the medium based on a detection result of the mark developer image by the developer image detection part, the mark developer image is formed in advance of formation of the developer image, the drive controller varies a carrying speed based on the detection result of the mark developer image by the developer image detection part, the carrying sensors are arranged on a medium carrying path and on an upstream side of the secondary transfer position in a carrying direction of the medium, the second carrying sensor being positioned closer to the secondary transfer position than the first carrying sensor is, wherein the detection result of the mark developer image is an estimated carrying distance (L1), when the estimated carrying distance is smaller than a predetermined value, the drive controller decreases a carrying speed of the medium from a first speed (V1) to a second speed (V2) and maintains the second speed (V2), and when the drive controller receives a medium detection signal (DPb) indicating that the second carrying sensor sensed the medium, the drive controller returns the carrying speed of the medium from the second speed (V2) to the first speed (V1).

20. An image forming apparatus, comprising:

a developer image forming part that is configured to form a developer image;

an intermediate transfer body that is configured to hold and carry the developer image that is transferred from the developer image forming part to a transferred surface thereof;

a primary transfer part that is configured to transfer the developer image from the developer image forming part to the transferred surface at a primary transfer position;

a drive mechanism that is configured to drive the intermediate transfer body to carry the developer image on the transferred surface on a carrying path that is defined from the primary transfer position to a secondary transfer position located on a downstream side of the primary transfer position;

a medium carrying mechanism that is configured to carry a medium to the secondary transfer position;

a secondary transfer part that is configured to transfer the developer image from the intermediate transfer body to the medium at the secondary transfer position;

a developer image detection part that is configured to detect the developer image on the intermediate transfer body;

a drive controller that is configured to control an operation of the medium carrying mechanism; and first and second carrying sensors that are configured to detect the medium passing thereby, wherein the developer image forming part forms a mark developer image, the primary transfer part transfers the mark developer image from the developer image forming part to the transferred surface of the intermediate transfer body, the drive mechanism drives the intermediate transfer body to carry the mark developer image on the transferred surface along the carrying path, the developer image detection part detects the mark developer image moving on the carrying path, the drive controller controls carrying of the medium based on a detection result of the mark developer image by the developer image detection part, the mark developer image is formed in advance of formation of the developer image, the drive controller varies a carrying speed based on the detection result of the mark developer image by the developer image detection part, the carrying sensors are arranged on medium carrying path and on an upstream side of the secondary transfer position in a carrying direction of the medium, the second carrying sensor being positioned closer to the secondary transfer position than the first carrying sensor is, wherein the detection result of the mark developer image is an estimated carrying distance (L1), when the estimated carrying distance is larger than a predetermined value, the drive controller increases a carrying speed of the medium from a first speed (V1) to an second speed (V3) and maintains the second speed (V3), and when the drive controller receives a medium detection signal (DPb) indicating that the second carrying sensor sensed the medium, the drive controller returns the carrying speed of the medium from the second speed (V3) to the first speed (V1).

* * * * *